US010703005B2

(12) United States Patent
Grijalva, II

(10) Patent No.: US 10,703,005 B2
(45) Date of Patent: Jul. 7, 2020

(54) LIFTING TANK FOR MANUFACTURING

(71) Applicant: The Boeing Company, Chicago, IL (US)

(72) Inventor: Ciro Grijalva, II, Graham, WA (US)

(73) Assignee: The Boeing Company, Chicago, IL (US)

( * ) Notice: Subject to any disclaimer, the term of this patent is extended or adjusted under 35 U.S.C. 154(b) by 226 days.

(21) Appl. No.: 15/474,327

(22) Filed: Mar. 30, 2017

(65) Prior Publication Data

US 2018/0281224 A1 Oct. 4, 2018

(51) Int. Cl.

| | |
|---|---|
| ***B26F 3/00*** | (2006.01) |
| ***B26D 7/27*** | (2006.01) |
| ***B26D 7/01*** | (2006.01) |

(52) U.S. Cl.

CPC ..... *B26F 3/008* (2013.01); *B26D 7/018* (2013.01); *B26D 7/27* (2013.01)

(58) Field of Classification Search

CPC ..... B26F 3/008; B26F 3/004; B26F 1/3813; B26D 7/27; B26D 7/2628; B26D 5/005; B26D 7/08; B26D 7/34; B24C 5/04; F01N 3/2853; Y10T 83/0591; Y10T 83/364; Y10T 29/49345

USPC ..... 83/13, 53, 177, 451, 550, 551, 22, 602, 83/649, 719, 614; 451/75, 88, 102, 36, 451/42, 38; 29/428, 56.5

See application file for complete search history.

(56) References Cited

U.S. PATENT DOCUMENTS

| | | | | |
|---|---|---|---|---|
| 5,857,901 | A * | 1/1999 | LaPoint | B24B 31/003 451/113 |
| 6,406,356 | B1 * | 6/2002 | Brooks | B24B 31/003 451/104 |
| 6,634,928 | B2 * | 10/2003 | Erickson | B24C 1/045 451/38 |
| 7,291,059 | B2 * | 11/2007 | Sugita | B26F 3/004 451/38 |
| 2008/0257274 | A1 * | 10/2008 | Drouillard | A01K 7/00 119/72 |
| 2009/0124178 | A1 * | 5/2009 | Ueyama | B24C 1/045 451/91 |
| 2015/0118942 | A1 * | 4/2015 | Hashish | B24C 3/06 451/80 |

FOREIGN PATENT DOCUMENTS

| | | | | |
|---|---|---|---|---|
| FR | 2889976 | A1 * | 8/2006 | B05C 3/10 |

OTHER PUBLICATIONS

"Extended Z 5 Axis Waterjet Systems," PaR Systems, Inc., Copyright 2017, 4 pages. http://www.par.com/waterjet-cutting/, accessed Mar. 29, 2017.

* cited by examiner

*Primary Examiner* — Ghassem Alie
(74) *Attorney, Agent, or Firm* — Yee & Associates, P.C.

(57) ABSTRACT

A system comprises a tank, a number of actuators, and an index table. The tank is configured to hold a fluid. The tank has a bottom, a number of walls, and an open top end. The number of actuators is configured to move the tank in a direction perpendicular to the bottom of the tank. The index table is configured to hold a workpiece above the open top end such that movement of the tank in the direction perpendicular to the bottom of the tank moves the tank towards or away from the workpiece.

20 Claims, 19 Drawing Sheets

LIFTING TANK FOR MANUFACTURING

BACKGROUND INFORMATION

1. Field

The present disclosure relates generally to manufacturing processes and, more specifically, to manufacturing processes using a tank of fluid. Still more particularly, the present disclosure relates to a tank raised for manufacturing processes.

2. Background

Several types of manufacturing processes include submerging all or a portion of a workpiece in fluid. As the size of a workpiece increases, the size of a tank holding the fluid for submersion also increases. As the size of a tank increases, the time to fill and drain the tank increases. Additionally, as the size of the tank increases, volume of the fluid to reach a desirable height within the tank also increases.

In some processes, to submerge the workpiece or a portion of the workpiece, the workpiece is lowered into the tank holding the fluid. However, lowering the workpiece into the tank may be undesirable in some processes. For example, some workpieces may be too undesirably complex to grasp. Some workpieces may be too heavy to desirably hoist and maneuver. Additionally, equipment for hoisting and maneuvering large workpieces may take an undesirable amount of space in a manufacturing environment. In some processes, maneuvering the large workpieces may take an undesirable amount of time.

In other processes, to submerge the workpiece or a portion of the workpiece, a level of fluid is changed within the tank. By changing the level of fluid in the tank, the level of fluid is changed relative to the workpiece within the tank. However, changing the level of fluid in the tank adds downtime to a manufacturing process. Additionally, the tank designed to change the level of fluid during processing is attached to additional support structures such as a pump and a reservoir. Support structures take up additional space in the manufacturing environment. Therefore, it would be desirable to have a method and apparatus for submerging the workpiece or a portion of the workpiece, where the method and apparatus take into account at least some of the issues discussed above, as well as other possible issues.

SUMMARY

An illustrative embodiment of the present disclosure provides a method for processing a workpiece. A measurement of a desirable height for a top surface of a fluid relative to the workpiece held on an index table is received. A stable level of the fluid is maintained within a tank configured to hold the fluid, wherein the tank has a bottom, a number of walls, and an open top end. The tank is raised relative to the index table such that the tank contains a portion of the index table and such that the top surface of the fluid within the tank is at the desirable height relative to the workpiece. The tank is lowered relative to the index table such that the tank no longer contains any portion of the index table.

Another illustrative embodiment of the present disclosure provides a system. The system comprises a tank, a number of actuators, and an index table. The tank is configured to hold a fluid. The tank has a bottom, a number of walls, and an open top end. The number of actuators is configured to move the tank in a direction perpendicular to the bottom of the tank. The index table is configured to hold a workpiece above the open top end such that movement of the tank in the direction perpendicular to the bottom of the tank moves the tank towards or away from the workpiece.

A further illustrative embodiment of the present disclosure provides a system. The system comprises an index table, a tank, a number of actuators, and a tool. The index table is configured to hold a workpiece. The tank is configured to hold a fluid. The tank has a bottom, a number of walls, and an open top end. The number of actuators is configured to move the tank in a direction perpendicular to the bottom of the tank such that the tank contains a portion of the index table. The tool is connected to a gantry system, wherein the tool is configured to perform a number of manufacturing functions on the workpiece, wherein the tool is suspended above the tank.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

Figure 1:
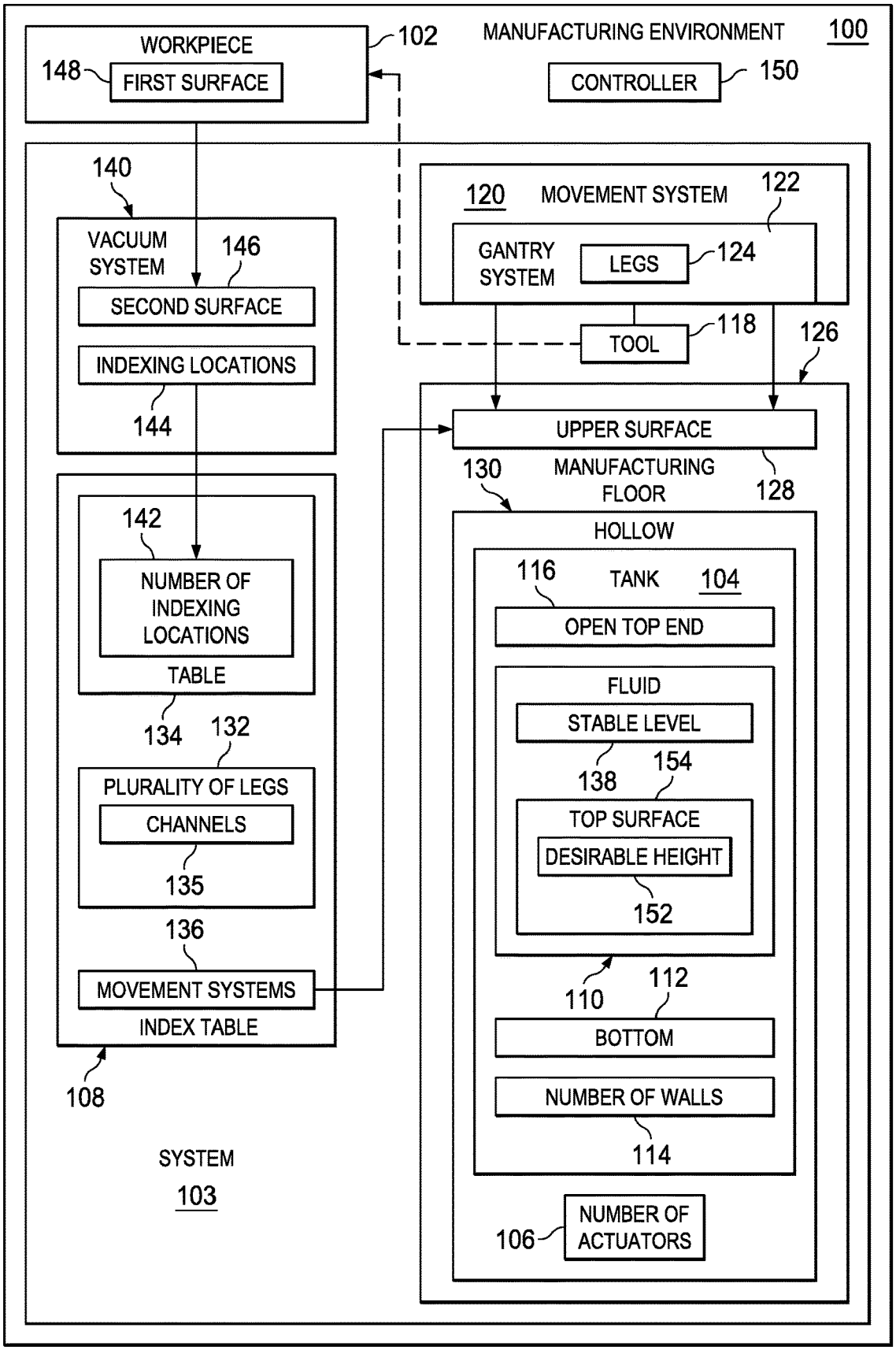
FIG. 1 is an illustration of a block diagram of a manufacturing environment in accordance with an illustrative embodiment.

The illustrative embodiments recognize and take into account one or more different considerations. For example, the illustrative embodiments recognize and take into account that a water jet cutter is one example of a manufacturing tool that utilizes a tank of fluid. The water jet cutter includes either a three-axis or a five-axis nozzle. In conventional water jets, water in a tank is raised enough to cover the water jet nozzle during operation. By covering the water jet nozzle, noise levels are reduced.

The illustrative embodiments recognize and take into account that water jets may be used to produce complex three-dimensional shapes. During operation of a five-axis water jet nozzle, there is a desirable level of water relative to the water jet nozzle. As the water jet nozzle moves across a complex three-dimensional shape, the water jet nozzle moves up and down relative to the tank. For the water jet nozzle to maintain a desirable difference in height from the water in the tank, the tank is filled and emptied during manufacturing.

The illustrative examples recognize and take into account that a drawback of existing equipment is that the steps to produce workpieces in the water jet add unnecessary non-value added time. The illustrative examples recognize and take into account that a current process consists of a loading table, a lifting mechanism and the water tank. The illustrative examples recognize and take into account that for conventional services, a holding fixture and workpiece to be trimmed travel from the loading table to an indexing structure in the tank and back to the loading table after trimming and inspecting. The tank fills and empties for each instance.

In a conventional water jet cutting process, the water jet tank is fixed within a cutting envelope of the machine. In a conventional water jet cutting process, the tank is filled and emptied by means of a pump and a large reservoir. Some conventional machines offer the ability to set the water levels by means of a machine setting.

In conventional water jet cutting, time to drain the tank may increase over time. The time to drain the tank may increase appreciably such that the increased time is noticeable by operators. The illustrative examples recognize and take into account that the increase in draining time may be caused by debris in a return tube.

The illustrative examples recognize and take into account that the time to fill and drain the tank to different fluid levels is non-value added time. The illustrative examples also recognize and take into account that by eliminating filling and draining of the tank may reduce or eliminate support structures for the draining and filling of the tank, such as pumps and a reservoir tank.

The illustrative examples recognize and take into account that some conventional five-axis water jet nozzles include a probe. In some illustrative processes, the jet cutting nozzle is completely submerged. The illustrative examples recognize and take into account that the probe performs a role of alignment of the workpiece to the Numerical Control program and inspection of the workpiece.

The illustrative examples recognize and take into account that in conventional water jet cutting, the fixture and workpiece are assembled on a staging table called a "loading table," then it is lifted, transported, and lowered into the tank by an overhead automated lifting structure. The illustrative examples recognize and take into account that in conventional water jet cutting, once the fixture is in the tank it is then indexed on a two pin and three or five pad support structure. This structure is affixed to the bottom of the tank. The overhead lifting structure then returns to its starting position over the loading table.

The illustrative examples recognize and take into account that the loading table and the lifting and loading process for the fixture and the workpiece may add an undesirable amount of time to manufacturing. Further, the illustrative examples recognize and take into account that the size of the loading table may limit the size of workpiece that may be processed. The illustrative examples recognize and take into account that eliminating the loading table may eliminate non-value added steps, activities, and functions from the system. Additionally, by eliminating the loading table, a footprint of the water jet cutting system may be reduced. The illustrative examples additionally recognize and take into account that eliminating the loading table may also reduce or eliminate support equipment for the loading table, such as indexing sensors for a conventional fixture within a conventional tank.

With reference now to the figures and, in particular, with reference to FIG. 1, an illustration of a block diagram of a manufacturing environment is depicted in accordance with an illustrative embodiment. Manufacturing environment 100 contains manufacturing equipment configured to perform manufacturing functions on workpiece 102. Manufacturing environment 100 contains system 103. System 103 comprises tank 104, number of actuators 106, and index table 108. Tank 104, number of actuators 106, and index table 108 may be described as a system. The system may be used to perform manufacturing functions on workpiece 102. Tank 104 is configured to hold fluid 110. Tank 104 has bottom 112, number of walls 114, and open top end 116.

Number of actuators 106 is configured to move tank 104 in a direction perpendicular to bottom 112 of tank 104. Number of actuators 106 is configured to move tank 104 in a direction perpendicular to bottom 112 of tank 104 such that tank 104 contains a portion of index table 108.

Index table 108 is configured to hold workpiece 102. More specifically, index table 108 is configured to hold workpiece 102 above open top end 116 such that movement of tank 104 in a direction perpendicular to bottom 112 of tank 104 moves tank 104 towards or away from workpiece 102.

Number of actuators 106 contains any desirable quantity of and any desirable type of actuators. A quantity of actuators within number of actuators 106 may be selected based on any desirable manufacturing or performance considerations. For example, a quantity of actuators may be selected based on at least one of reliability considerations, an amount of space around tank 104 available for number of actuators 106 and supporting structures, a weight of tank 104, or a desired type of actuator.

Controller 150 is communicatively coupled to at least one of tool 118, movement system 120, or number of actuators 106. Controller 150 may send commands to number of actuators 106 to lift tank 104 to achieve desirable height 152 of top surface 154 of fluid 110 relative to workpiece 102 held on index table 108. Controller 150 may receive information regarding a position of tool 118 through communication with at least one of tool 118 or movement system 120. Controller 150 may send commands to number of actuators 106 based on the position of tool 118. For example, desirable height 152 of top surface 154 of fluid 110 relative to workpiece 102 will cover tool 118 during water jet cutting using tool 118. Due to the elevations of workpiece 102, desirable height 152 changes as tool 118 moves across workpiece 102. In some illustrative examples, controller 150 may also send commands to tool 118.

As used herein, the phrase "at least one of," when used with a list of items, means different combinations of one or more of the listed items may be used, and only one of each item in the list may be needed. In other words, "at least one of" means any combination of items and number of items may be used from the list, but not all of the items in the list are required. The item may be a particular object, a thing, or a category.

For example, "at least one of item A, item B, or item C" may include, without limitation, item A, item A and item B, or item B. This example also may include item A, item B, and item C or item B and item C. Of course, any combination of these items may be present. In other examples, "at least one of" may be, for example, without limitation, two of item A, one of item B, and ten of item C; four of item B and seven of item C; or other suitable combinations.

A type of actuator for number of actuators 106 may be selected based on at least one of manufacturing process specifications or specifications of tank 104. For example, number of actuators 106 may be selected based on at least one of a desired speed of movement of tank 104, a weight of tank 104 and fluid 110, an amount of space around tank 104 available for number of actuators 106 and supporting structures, availability of utilities within manufacturing environment 100 for number of actuators 106, or other desirable factors. In one illustrative example, number of actuators 106 is a number of mechanical actuators, such as scissor lifts. In another illustrative example, number of actuators 106 is a number of hydraulic actuators. In yet another example, number of actuators 106 is a number of electric actuators.

The weight of tank 104 with fluid 110 is dependent on the size of tank 104, the material of tank 104, the type of fluid 110, and the volume of fluid 110. In one illustrative example, the weight of tank 104 with fluid 110 is up to 20,000 lbs. Number of actuators 106 is selected taking into account the weight of tank 104. In this illustrative example, number of actuators 106 takes the form of electric screw jacks (lifters). Conventional electric screw jacks are available with lifting capacities of up to 250 tons. These types of jacks are used for leveling log homes and loading and unloading supplies to cruise ships.

In some illustrative examples, the jack lifts have one electric motor driving all the jacks. In other illustrative examples, all of the jack lifts are independent. The typical lifting speeds for screw jacks are between 14 and 55 inches per minute. Double lead screws may be used for faster speeds.

In some illustrative examples, a manufacturing process is performed on workpiece 102 by moving tank 104 relative to workpiece 102. For example, workpiece 102 may have a layer of material added to or removed from workpiece 102 by submerging all or a portion of workpiece 102 in fluid 110. For example, when fluid 110 is paint, at least a portion of workpiece 102 may be painted by lifting tank 104 towards workpiece 102 and submerging at least a portion of workpiece 102 in fluid 110. As another example, when fluid 110 is a solvent, at least a portion of workpiece 102 may have a surface coating removed by lifting tank 104 towards workpiece 102 and submerging at least a portion of workpiece 102 in fluid 110.

In other illustrative examples, tank 104 supports other manufacturing processes. For example, fluid 110 in tank 104 may supply sound dampening, conduction, cooling, or other manufacturing support functions.

For example, as depicted, system 103 of manufacturing environment 100 contains tool 118 configured to perform a number of manufacturing functions on workpiece 102, wherein tool 118 is suspended above tank 104. Tool 118 may be any desirable type of tool. For example, tool 118 may be a three-axis or a five-axis water jet cutter. In another example, tool 118 may be a probe or other form of inspection or metrology tool. Thus, manufacturing functions performed on workpiece 102 may be one of water jet cutting or probing.

To move relative to workpiece 102 and perform manufacturing functions on workpiece 102, tool 118 is connected to movement system 120. Movement system 120 may take any desirable form. In one illustrative example, movement system 120 is a robotic arm. In another illustrative example, movement system 120 includes a crane. In yet another illustrative example, movement system 120 includes gantry system 122.

As depicted, tool 118 is connected to gantry system 122, and legs 124 of gantry system 122 straddle tank 104. Legs 124 of gantry system 122 are configured to move in a first direction relative to tank 104, and tool 118 moves relative to gantry system 122 in a second direction perpendicular to the first direction.

As depicted, manufacturing environment 100 has manufacturing floor 126 having upper surface 128 and hollow 130 configured to house tank 104. Number of actuators 106 is configured to move tank 104 such that open top end 116 is above upper surface 128 of manufacturing floor 126. Movement system 120 is positioned at or below upper surface 128 of manufacturing floor 126. In one illustrative example, legs 124 of gantry system 122 move along upper surface 128.

Index table 108 comprises plurality of legs 132 and table 134, wherein each of plurality of legs 132 comprises a channel that receives a wall of number of walls 114 as tank 104 moves towards index table 108. Channels 135 are formed by plurality of legs 132.

Index table 108 is held above hollow 130. In some illustrative examples, index table 108 is even with upper surface 128. Index table 108 holds workpiece 102 over tank 104.

Index table 108 comprises plurality of legs 132 and table 134. Plurality of legs 132 is connected to movement systems 136. Each of plurality of legs 132 is connected to a movement system. Specifically, each of plurality of legs 132 is connected to a movement system of movement systems 136.

Movement systems 136 are configured to move index table 108 and workpiece 102 away from tank 104 and gantry system 122. In some illustrative examples, each movement system travels along upper surface 128 of manufacturing floor 126 containing tank 104. When tank 104 is at its lowest position, upper surface 128 of manufacturing floor 126 is level or above open top end 116 of tank 104. Movement systems 136 are configured to position index table 108 over tank 104 such that tool 118 performs a manufacturing function on workpiece 102 over tank 104. After the manufacturing function is performed on workpiece 102, movement systems 136 move index table 108 away from tool 118 and tank 104. Movement systems 136 are configured to move index table 108 and workpiece 102 away from tank 104 and gantry system 122.

To perform manufacturing functions on workpiece 102, tank 104 is raised towards workpiece 102 while maintaining stable level 138 of fluid 110 within tank 104. Workpiece 102 is held on index table 108 above tank 104 by vacuum system 140. Index table 108 has number of indexing locations 142. Vacuum system 140 has indexing locations 144 to interface with number of indexing locations 142 of index table 108 and second surface 146 having a shape complementary to first surface 148 of workpiece 102, wherein vacuum system 140 connects workpiece 102 to index table 108.

Index table 108 does not index to locations within tank 104. Instead, vacuum system 140 indexes to index table 108. Location sensors for indexing a fixture to a tank in conventional systems may be eliminated in the illustrative examples.

Vacuum system 140 is used to clamp workpiece 102 onto index table 108 and can be operated automatically or manually. Vacuum system 140 comprises a pump, a hose reel, a hose, and a connector.

In conventional machines, the hose reel is placed under the loading table. In conventional machines, the hose is attached to the fixture tool. In some machines, the hose travels with the fixture into the tank and travels out and back after trimming to initial position over the loading table.

Vacuum system 140 may have a lower cost of acquisition and may reduce maintenance-related costs over a conventional vacuum system. For example, wear and tear on the hose may result from tension induced in the vacuum hose during movement of a conventional fixture.

Vacuum system 140 may improve ergonomics over a conventional vacuum system. Vacuum system 140 may not present a trip hazard to operators in manufacturing environment 100. Vacuum system 140 may reduce complexity of designing equipment in manufacturing environment 100. For example, vacuum system 140 reduces or eliminates vacuum hose clearance concerns.

By maintaining stable level 138 of fluid 110 within tank 104, a reservoir need not be present. By moving tank 104 relative to workpiece 102, a desired amount of workpiece 102 may be submerged within fluid 110 without changing a volume of fluid 110 within tank 104. By moving tank 104 relative to workpiece 102, at least one of manufacturing time, manufacturing cost, or amount of additional manufacturing tooling is reduced.

The illustration of manufacturing environment 100 in FIG. 1 is not meant to imply physical or architectural limitations to the manner in which an illustrative embodiment may be implemented. Other components in addition to, or in place of, the ones illustrated may be used. Some components may be unnecessary. Also, the blocks are presented to illustrate some functional components. One or more of these blocks may be combined, divided, or combined and divided into different blocks when implemented in an illustrative embodiment.

For example, in some illustrative examples, plurality of legs 132 does not have channels 135. As another example, submerging workpiece 102 within tank 104 may perform the manufacturing functions. In this example, tool 118 and movement system 120 may not be present in manufacturing environment 100.

Figure 2:
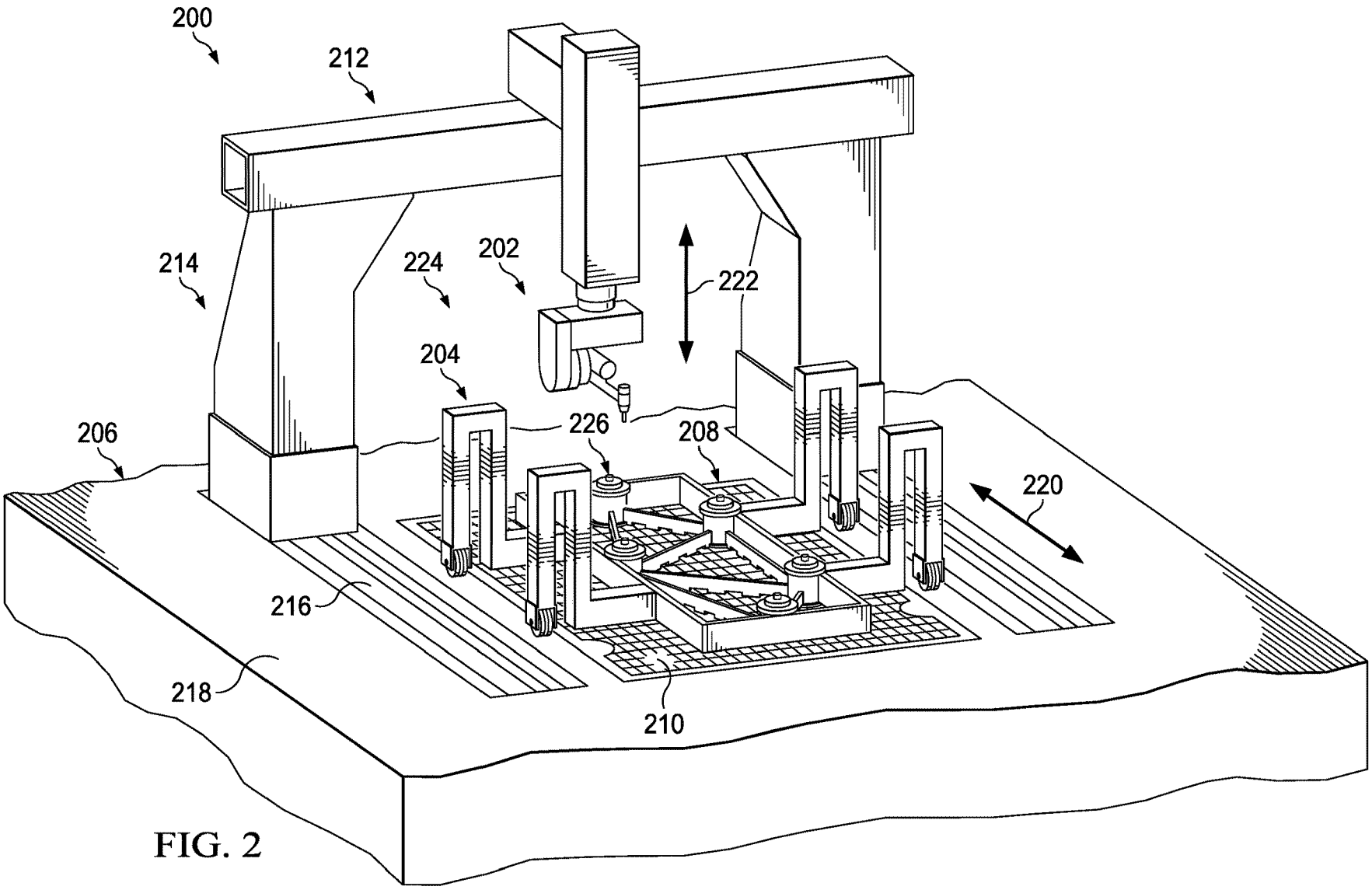
FIG. 2 is an illustration of an isometric view of a manufacturing environment with a lifting tank in accordance with an illustrative embodiment.

Turning now to FIG. 2, an illustration of an isometric view of a manufacturing environment with a lifting tank is depicted in accordance with an illustrative embodiment. Manufacturing environment 200 is a physical implementation of manufacturing environment 100 of FIG. 1.

Manufacturing environment 200 includes tool 202, index table 204, and manufacturing floor 206. Index table 204 is suspended above hollow 208 in manufacturing floor 206. Index table 204 is connected to screen 210.

In this illustrative example, tool 202 is an end effector. More specifically, in this illustrative example, tool 202 is a water jet cutting head end effector. Tool 202 is connected to gantry system 212 with legs 214 straddling hollow 208.

Legs 214 move along rails 216 below upper surface 218 of manufacturing floor 206. Legs 214 of gantry system 212 are configured to move in first direction 220 relative to hollow 208. By moving relative to hollow 208, legs 214 move relative to a tank (not depicted) within hollow 208. By legs 214 moving along rails 216, gantry system 212 moves tool 202 in first direction 220. Tool 202 moves relative to gantry system 212 in second direction 222 perpendicular to first direction 220.

Index table 204 moves in first direction 220 to enter and exit operating envelope 224 of tool 202. Index table 204 moves using movement systems attached to legs 214. Each leg of legs 214 is attached to a movement system.

Index table 204 has number of indexing locations 226. Number of indexing locations 226 interface with indexing locations of a vacuum system (not depicted) to connect a workpiece to index table 204.

Figure 3:
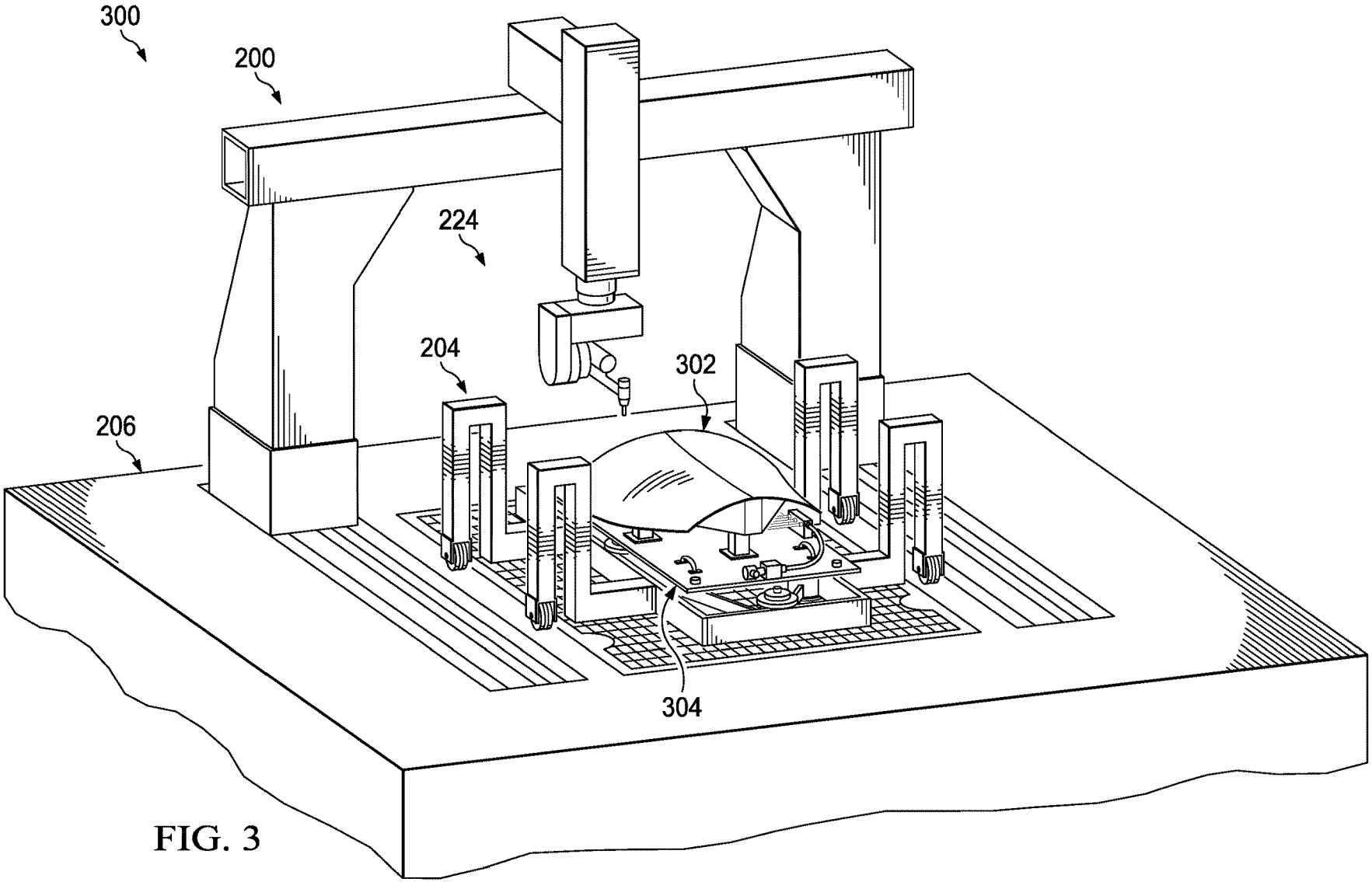
FIG. 3 is an illustration of an isometric view of a manufacturing environment with a workpiece on an index table in accordance with an illustrative embodiment.

Turning now to FIG. 3, an illustration of an isometric view of a manufacturing environment with a workpiece on an index table is depicted in accordance with an illustrative embodiment. View 300 is an isometric view of manufacturing environment 200 with workpiece 302 attached to index table 204. As depicted, workpiece 302 is within operating envelope 224 of tool 202. Workpiece 302 is connected to index table 204 by vacuum system 304.

Figure 4:
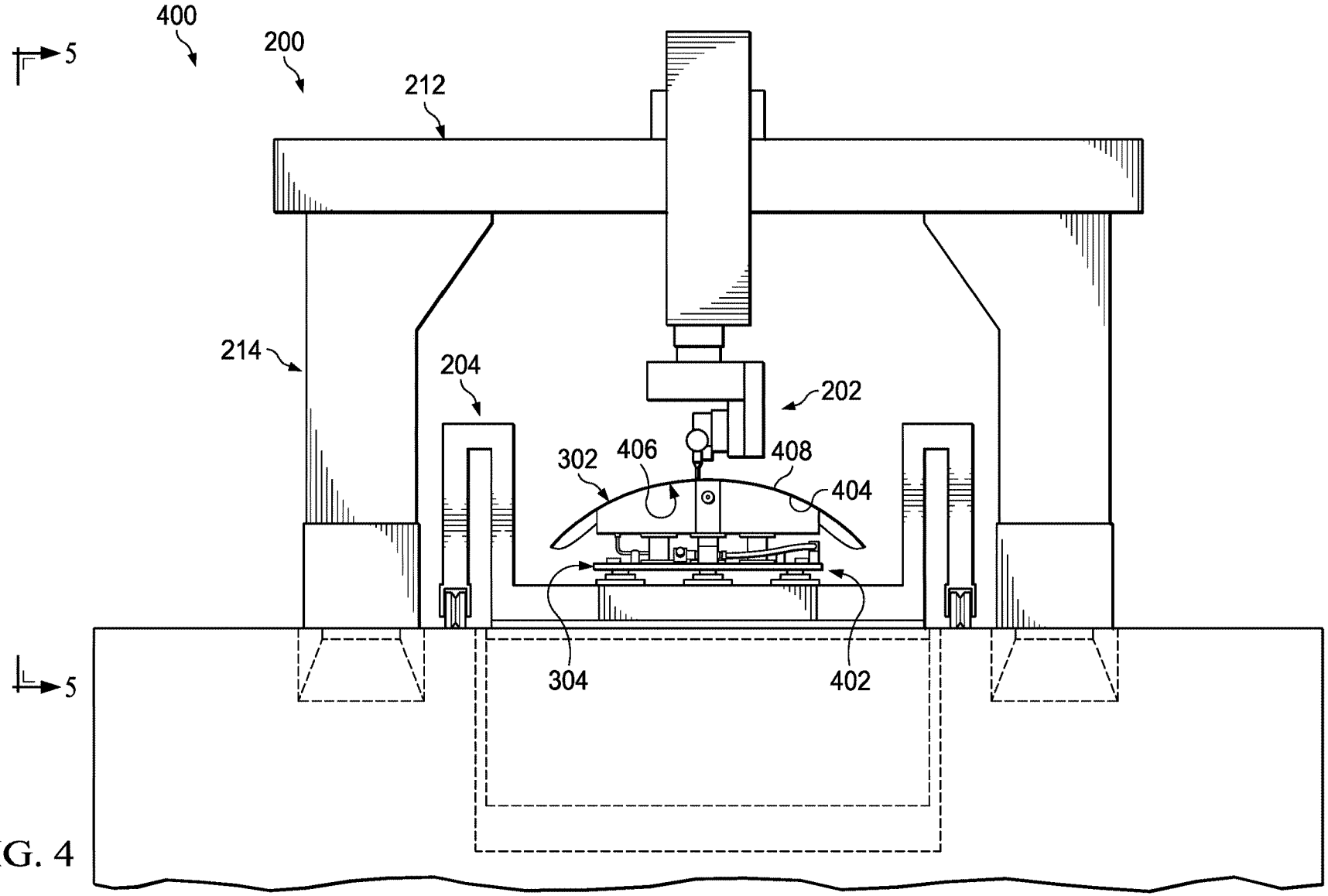
FIG. 4 is an illustration of a front view of a manufacturing environment with a workpiece on an index table in accordance with an illustrative embodiment.

Turning now to FIG. 4, an illustration of a front view of a manufacturing environment with a workpiece on an index table is depicted in accordance with an illustrative embodiment. View 400 is a front view of manufacturing environment 200 with workpiece 302 connected to index table 204. As depicted in view 400, vacuum system 304 connects workpiece 302 to index table 204.

Vacuum system 304 has indexing locations 402 to interface with number of indexing locations 226 of index table 204 and second surface 404 having shape 406 complementary to first surface 408 of workpiece 302, wherein vacuum system 304 connects workpiece 302 to index table 204.

Figure 5:
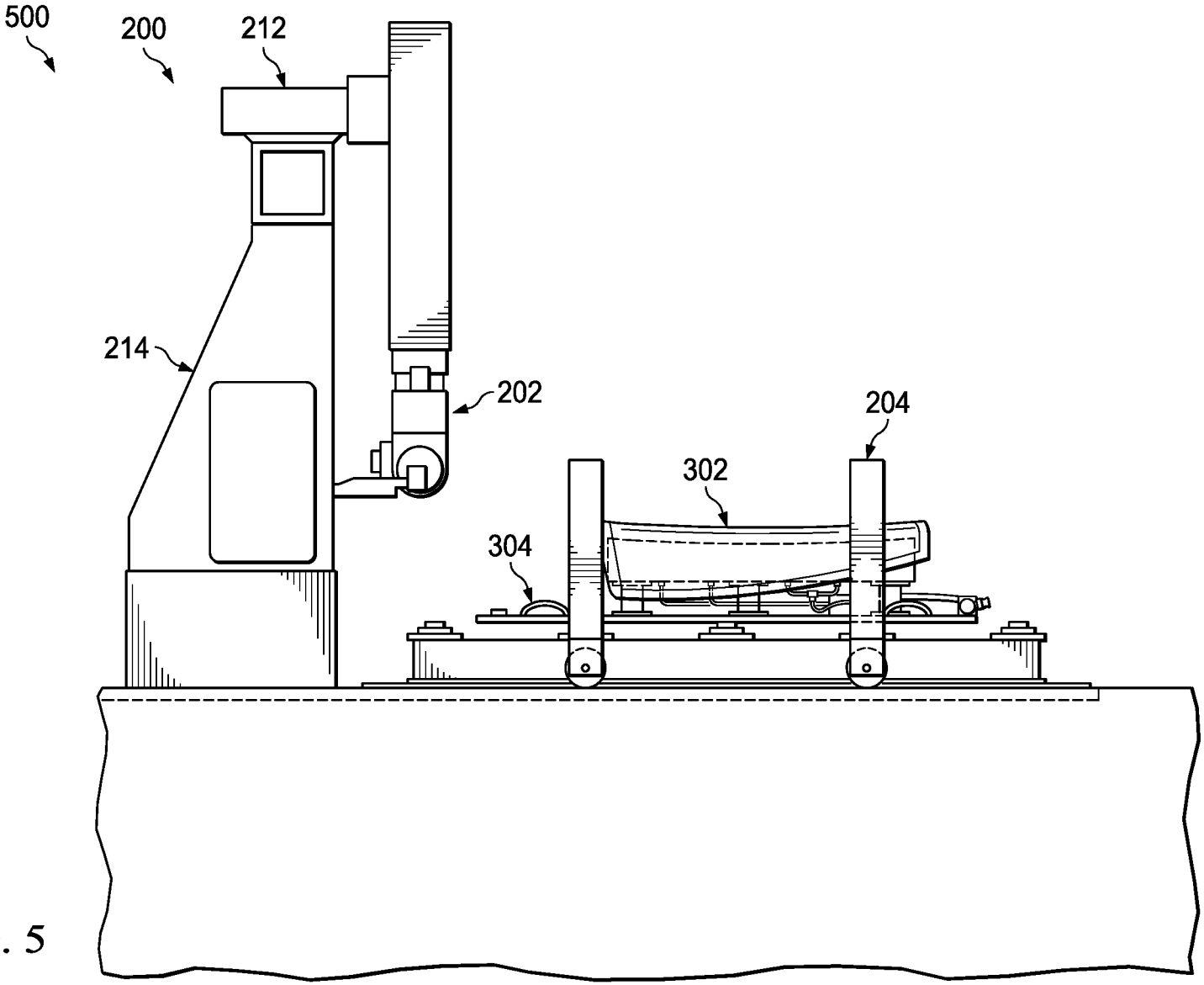
FIG. 5 is an illustration of a side view of a manufacturing environment with a workpiece on an index table in accordance with an illustrative embodiment.

Turning now to FIG. 5, an illustration of a side view of a manufacturing environment with a workpiece on an index table is depicted in accordance with an illustrative embodiment. View 500 is a side view of manufacturing environment 200 with workpiece 302 connected to index table 204. View 500 is a side view from direction 5 of FIG. 4.

Figure 6:
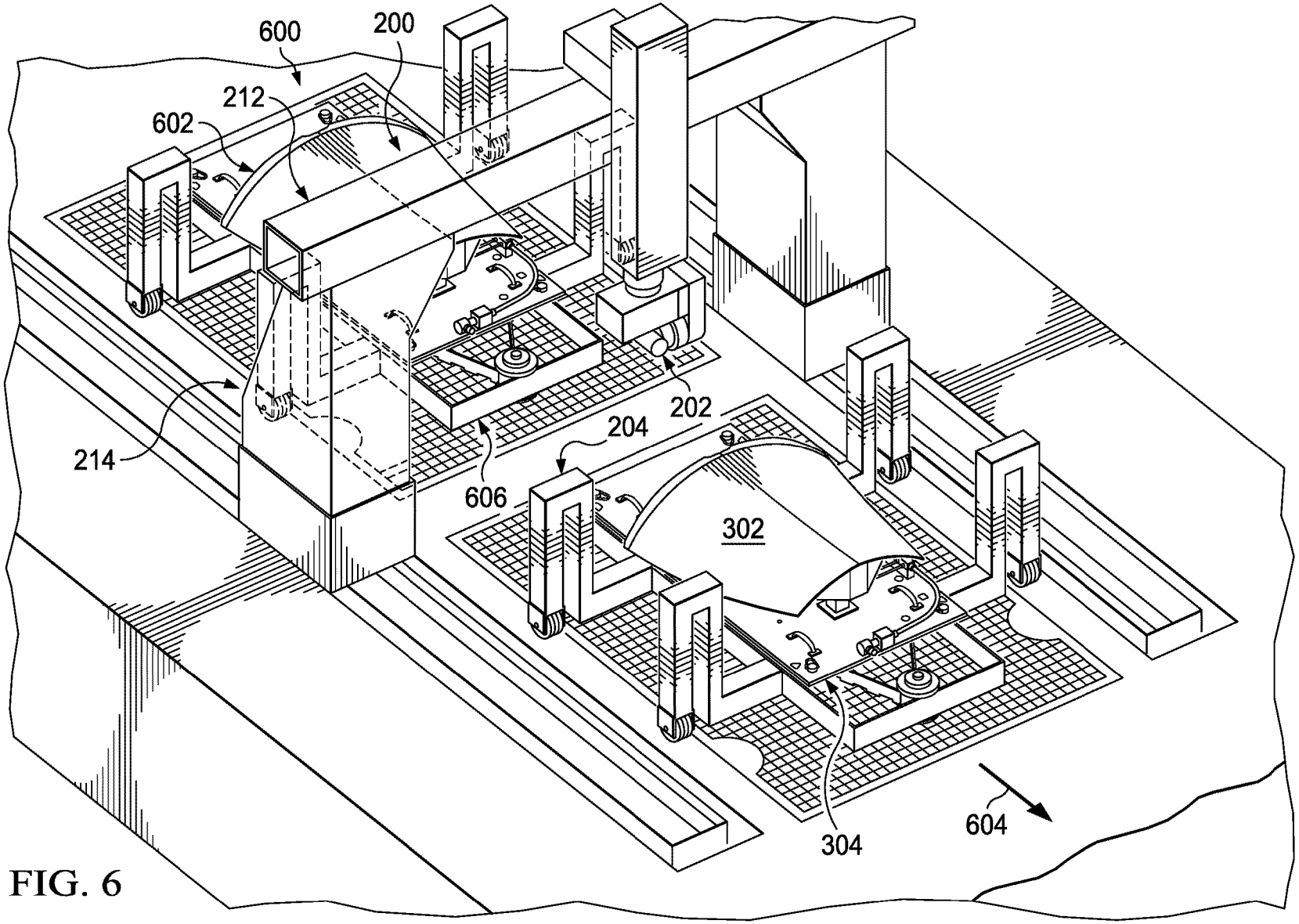
FIG. 6 is an illustration of a top isometric view of a manufacturing environment with a workpiece on an index table in accordance with an illustrative embodiment.

Turning now to FIG. 6, an illustration of a top isometric view of a manufacturing environment with a workpiece on an index table is depicted in accordance with an illustrative embodiment. View 600 is a top isometric view of manufacturing environment 200 with workpiece 302 connected to index table 204. A second workpiece, workpiece 602, is also visible in view 600. After performing a manufacturing process on workpiece 302, index table 204 is moved in direction 604 away from tool 202. Index table 606 moves in direction 604 to place workpiece 602 over hollow 208 and a tank (not depicted).

By each workpiece having its own respective index table, processing time may be reduced. In conventional water jet cutting processes, a fixture is positioned relative to the tank by a loader that lifts and loads the fixture for each workpiece. After processing, the loader lifts and retrieves the fixture and workpiece. Loading and unloading downtime may be reduced or eliminated by each workpiece having its own respective index table with movement systems, as depicted.

By each index table having movement systems, the loader may be eliminated. Eliminating the loader removes a large piece of equipment, thus increasing available space in the manufacturing environment. Eliminating the loader provides easier access to the tank. Movement systems associated with index table 204 facilitate access to the tank for maintenance.

In conventional jet cutting systems, the fixture loader is a moving structure that lifts the fixture and workpiece together from the loading table and transports it into position in the tank. This is an automated step. The illustrative examples eliminate the loader. Instead, each index table, such as index table 204 and index table 606, use movement systems connected to the respective index tables to move relative to the tank.

By removing the fixture loader, manufacturing time may be reduced. In the conventional process, the time it takes the fixture loader to place the workpiece and fixture is repeated each time the fixture is placed into the tank or removed from the tank. This time is repeated if alignment or inspection is repeated. By removing the fixture loader, this time is reduced or eliminated.

Further, removing the fixture loader provides better ergonomic clearance around tool 202 and gantry system 212 for operators within manufacturing environment 200. For example, removing the fixture loader from conventional systems removes some overhead obstructions for operators. Removing the fixture loader from conventional systems may improve safety for manufacturing environment 200.

Movement systems on index table 204 and index table 606 may decrease complexity of loading and unloading workpieces compared to a conventional fixture loader. Further, by eliminating the fixture loader, maintenance and, therefore, maintenance costs, that is associated with the loader is eliminated. Eliminating the fixture loader may reduce the machine foot print. Additionally, removing the fixture loader may reduce manufacturing downtime due to operation of the fixture loader or due to downtime of the fixture loader.

Figure 7:
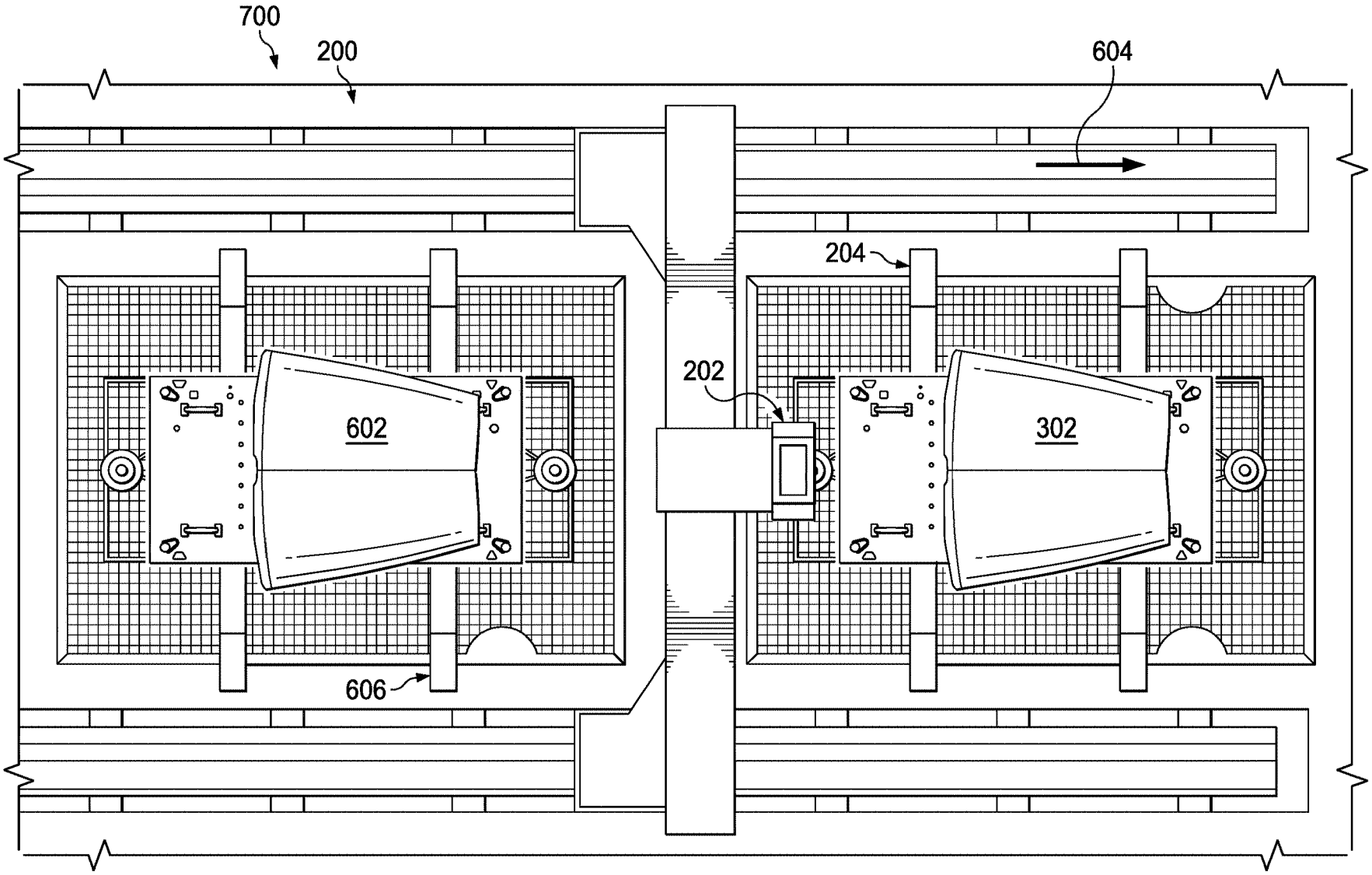
FIG. 7 is an illustration of a top view of a manufacturing environment with a workpiece on an index table in accordance with an illustrative embodiment.

Turning now to FIG. 7, an illustration of a top view of a manufacturing environment with a workpiece on an index table is depicted in accordance with an illustrative embodiment. View 700 is a top view of manufacturing environment 200 with workpiece 302 connected to index table 204 and workpiece 602 connected to index table 606. As can be seen in FIG. 7, after performing manufacturing functions on workpiece 302, both index table 204 and index table 606 are moved in direction 604. After moving index table 204 and index table 606 in direction 604, index table 606 is positioned over hollow 208 and under tool 202 so that a manufacturing function may be performed on workpiece 602.

FIGS. 2-7 demonstrate manufacturing environment 200 from different viewpoints. FIGS. 2-7 are not meant to imply physical or architectural limitations to the manner in which an illustrative embodiment may be implemented. Components of manufacturing environment 200 may have different designs or orientations.

Figure 8:
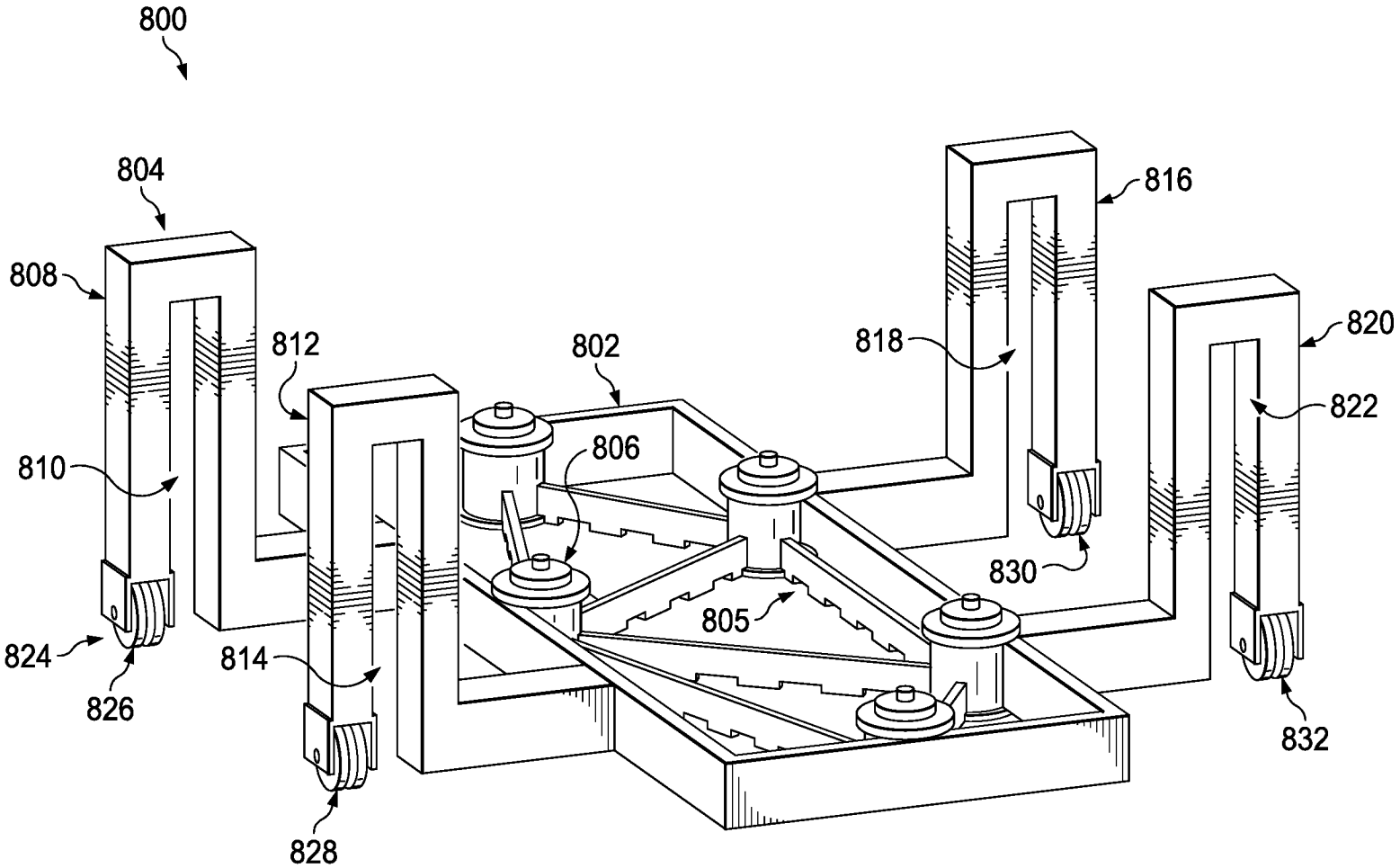
FIG. 8 is an illustration of an isometric view of an index table in accordance with an illustrative embodiment.
Figure 9:
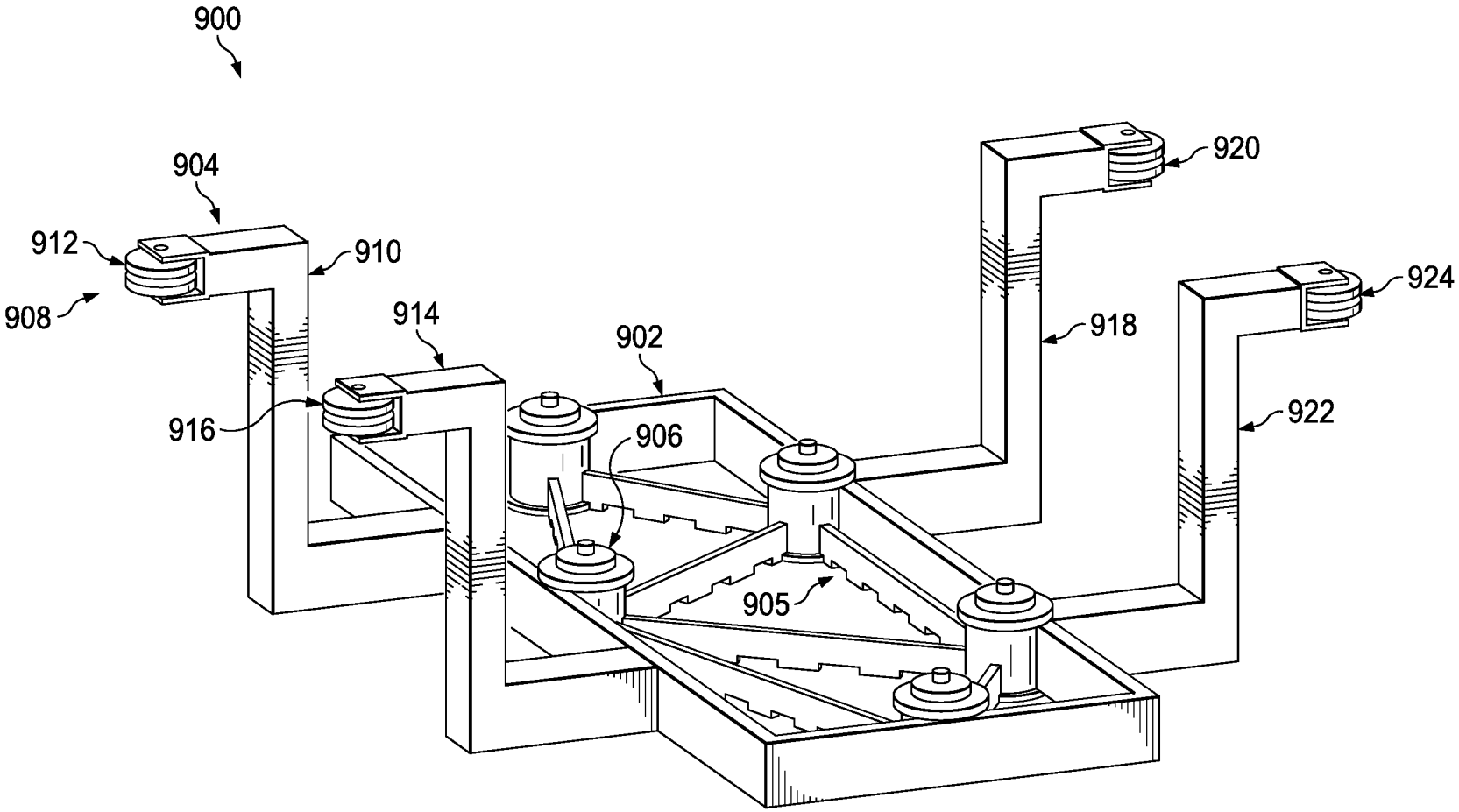
FIG. 9 is another illustration of an isometric view of an index table in accordance with an illustrative embodiment.
Figure 10:
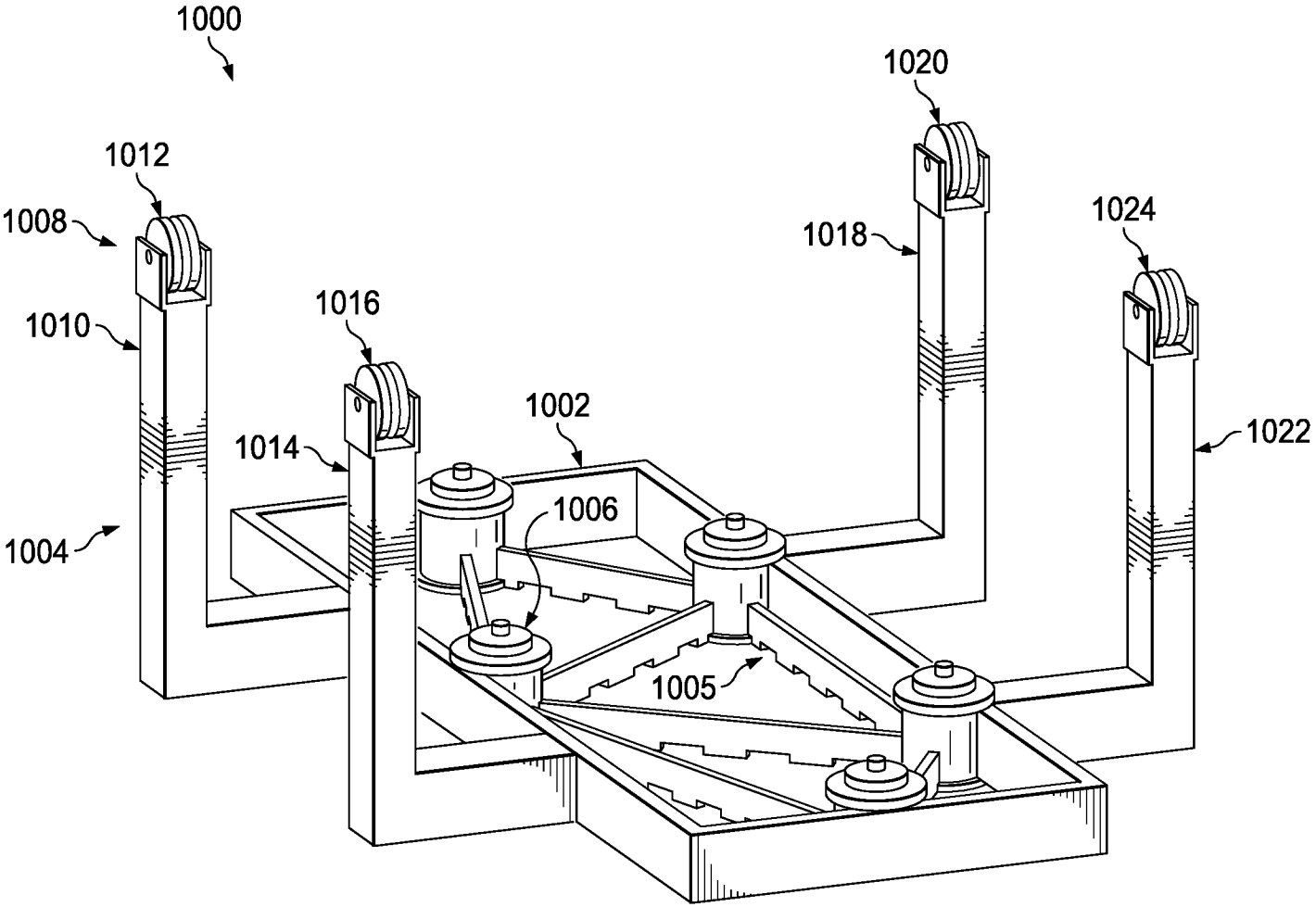
FIG. 10 is yet another illustration of an isometric view of an index table in accordance with an illustrative embodiment.

FIGS. 8-10 display some non-limiting examples of physical implementations of an index table. Turning now to FIG. 8, an illustration of an isometric view of an index table is depicted in accordance with an illustrative embodiment. Index table 800 may be a physical implementation of index table 108 of FIG. 1. Index table 800 may be used in a manufacturing environment, such as manufacturing environment 200 of FIG. 2. Index table 800, as depicted, is the same as index table 204 of FIG. 2.

Index table 800 has table 802 and plurality of legs 804. Table 802 desirably has plurality of holes 805 such that a fluid flows through table 802. Plurality of holes 805 lowers resistance to the fluid moving across a workpiece connected to index table 800.

Index table 800 has number of indexing locations 806 associated with table 802. Number of indexing locations 806 is used to interface with a vacuum system. By having number of indexing locations 806, index table 800 may be used for different designs of the workpiece. Each vacuum system is designed to interface with a specific workpiece. The vacuum systems are interchangeable using number of indexing locations 806.

Each of plurality of legs 804 comprises a channel that receives a wall of the number of walls of a tank as the tank moves towards index table 800. As depicted, leg 808 has channel 810, leg 812 has channel 814, leg 816 has channel 818, and leg 820 has channel 822.

Index table 800 is connected to movement systems 824. Movement systems 824 are configured to move index table 800 and the workpiece connected to index table 800 away from a tank and a gantry system. Each of plurality of legs 804 is connected to a movement system. Leg 808 is connected to movement system 826, leg 812 is connected to movement system 828, leg 816 is connected to movement system 830, and leg 820 is connected to movement system 832.

Although movement systems 824 are depicted as wheels, movement systems 824 may take any desirable form. Movement systems 824 may be selected from at least one of rails, wheels, tracks, roller balls, or other desirable movement systems.

Turning now to FIG. 9, an illustration of an isometric view of an index table is depicted in accordance with an illustrative embodiment. Index table 900 is a physical implementation of index table 108 of FIG. 1. Index table 900 may be used in a manufacturing environment, such as manufacturing environment 200 of FIG. 2.

Index table 900 has table 902 and plurality of legs 904. Index table 900 is substantially the same as index table 800 of FIG. 8, but plurality of legs 904 has a different shape than plurality of legs 804 of FIG. 8. Like table 802 of FIG. 8, table 902 desirably has plurality of holes 905 such that a fluid flows through table 902. Plurality of holes 905 lowers resistance to the fluid moving across a workpiece connected to index table 900.

Index table 900 has number of indexing locations 906 associated with table 902. Number of indexing locations 906 is used to interface with a vacuum system. By having number of indexing locations 906, index table 900 may be used for different designs of the workpiece. Each vacuum system is designed to interface with a specific workpiece. The vacuum systems are interchangeable using number of indexing locations 906.

Although number of indexing locations 806 of FIG. 8 and number of indexing locations 906 have the same design, number of indexing locations 906 may have any desirable shape, size, or layout. The design for number of indexing locations 906 may be standardized.

Index table 900 is connected to movement systems 908. Movement systems 908 are configured to move index table 900 and the workpiece connected to index table 900 away from a tank and a gantry system. Each of plurality of legs 904 is connected to a movement system. Leg 910 is connected to movement system 912, leg 914 is connected to movement system 916, leg 918 is connected to movement system 920, and leg 922 is connected to movement system 924.

Although movement systems 908 are depicted as pulley wheels, movement systems 908 may take any desirable form. Movement systems 908 may be selected from at least one of rails, wheels, tracks, roller balls, or other desirable movement systems.

A track, a rail, a wire, or other desirable guide would interface with movement systems 908 as depicted. Thus, unlike movement systems 824 of FIG. 8, movement systems 908 would not contact an upper surface of a manufacturing floor. Instead, a set of guides would extend through a gantry system and between the legs of the gantry system of the tool of a manufacturing environment.

Turning now to FIG. 10, an illustration of an isometric view of an index table is depicted in accordance with an illustrative embodiment. Index table 1000 is a physical implementation of index table 108 of FIG. 1. Index table 1000 may be used in a manufacturing environment, such as manufacturing environment 200 of FIG. 2.

Index table 1000 has table 1002 and plurality of legs 1004. Index table 1000 is substantially the same as index table 800 of FIG. 8, but plurality of legs 1004 has a different shape than plurality of legs 804 of FIG. 8. Like table 802 of FIG. 8, table 1002 desirably has plurality of holes 1005 such that a fluid flows through table 1002. Plurality of holes 1005 lowers resistance to the fluid moving across a workpiece connected to index table 1000.

Index table 1000 has number of indexing locations 1006 associated with table 1002. Number of indexing locations 1006 is used to interface with a vacuum system. By having number of indexing locations 1006, index table 1000 may be used for different designs of the workpiece. Each vacuum system is designed to interface with a specific workpiece. The vacuum systems are interchangeable using number of indexing locations 1006.

Although number of indexing locations 806 of FIG. 8 and number of indexing locations 1006 have the same design, number of indexing locations 1006 may have any desirable shape, size, or layout. The design for number of indexing locations 1006 may be standardized.

Index table 1000 is connected to movement systems 1008. Movement systems 1008 are configured to move index table 1000 and the workpiece connected to index table 1000 away from a tank and a gantry system. Each of plurality of legs 1004 is connected to a movement system. Leg 1010 is connected to movement system 1012, leg 1014 is connected to movement system 1016, leg 1018 is connected to movement system 1020, and leg 1022 is connected to movement system 1024.

Although movement systems 1008 are depicted as pulley wheels, movement systems 1008 may take any desirable form. Movement systems 1008 may be selected from at least one of rails, wheels, tracks, roller balls, or other desirable movement systems.

A track, a rail, a wire, or other desirable guide would interface with movement systems 1008 as depicted. Thus, unlike movement systems 824 of FIG. 8, movement systems 1008 would not contact an upper surface of a manufacturing floor. Instead, a set of guides would extend through a gantry system and between the legs of the gantry system of the tool of a manufacturing environment.

Figure 11:
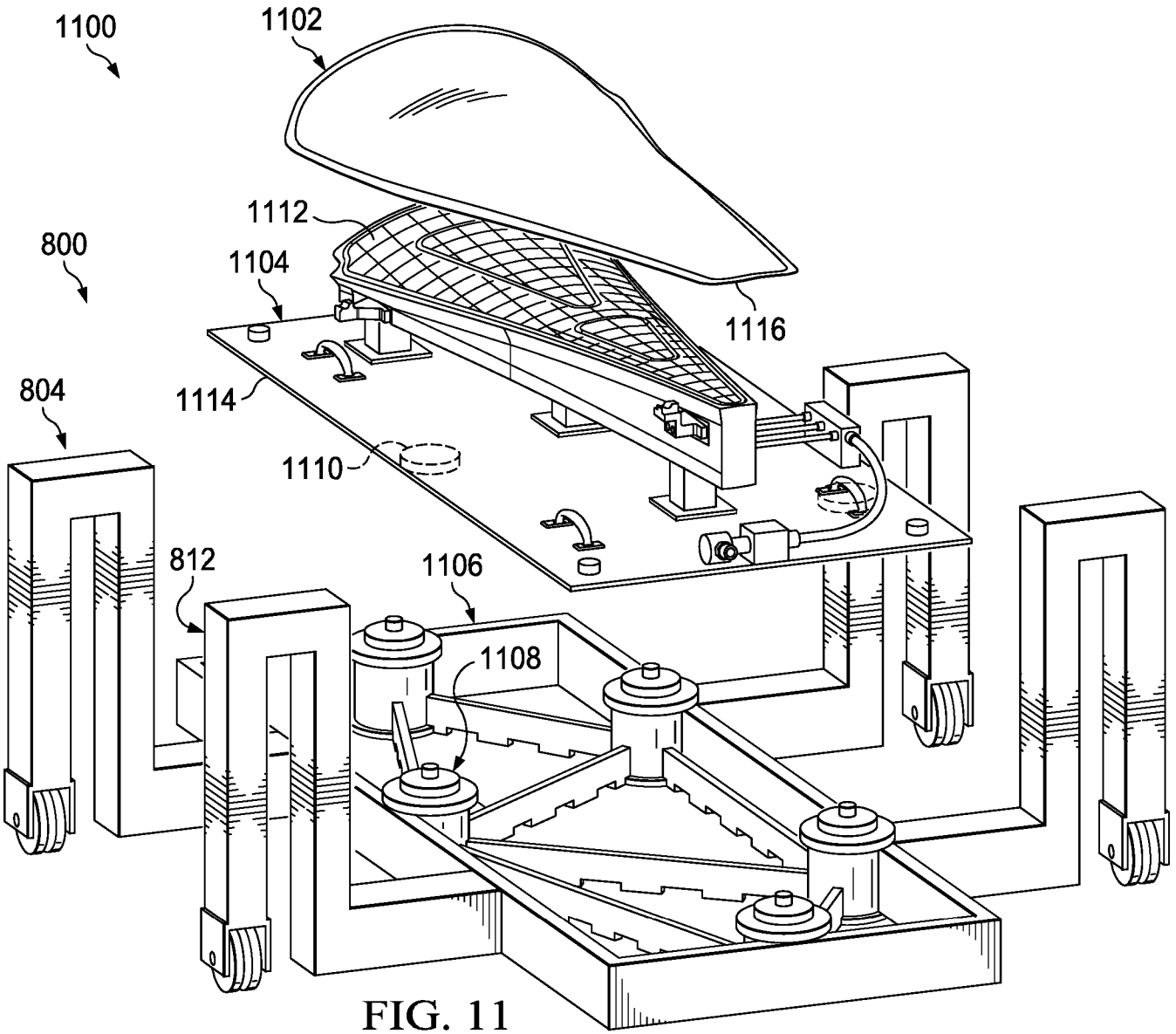
FIG. 11 is an illustration of an exploded view of a workpiece, a vacuum system, and an index table in accordance with an illustrative embodiment.

Turning now to FIG. 11, an illustration of an exploded view of a workpiece, a vacuum system, and an index table is depicted in accordance with an illustrative embodiment. View 1100 is an exploded view of workpiece 1102, vacuum system 1104, and index table 1106. Workpiece 1102 may be a physical implementation of workpiece 102 of FIG. 1. Vacuum system 1104 may be a physical implementation of vacuum system 140 of FIG. 1. Index table 1106 may be a physical implementation of index table 108 of FIG. 1. Index table 1106 has number of indexing locations 1108. Vacuum system 1104 has indexing locations 1110 to interface with number of indexing locations 1108 of index table 1106 and second surface 1112 having shape 1114 complementary to first surface 1116 of workpiece 1102. Vacuum system 1104 connects workpiece 1102 to index table 1106.

As depicted, workpiece 1102 is different from workpiece 302 of FIG. 3. Vacuum system 1104 is different from vacuum system 304 of FIG. 3 because workpiece 1102 is different from workpiece 302.

Figure 12:
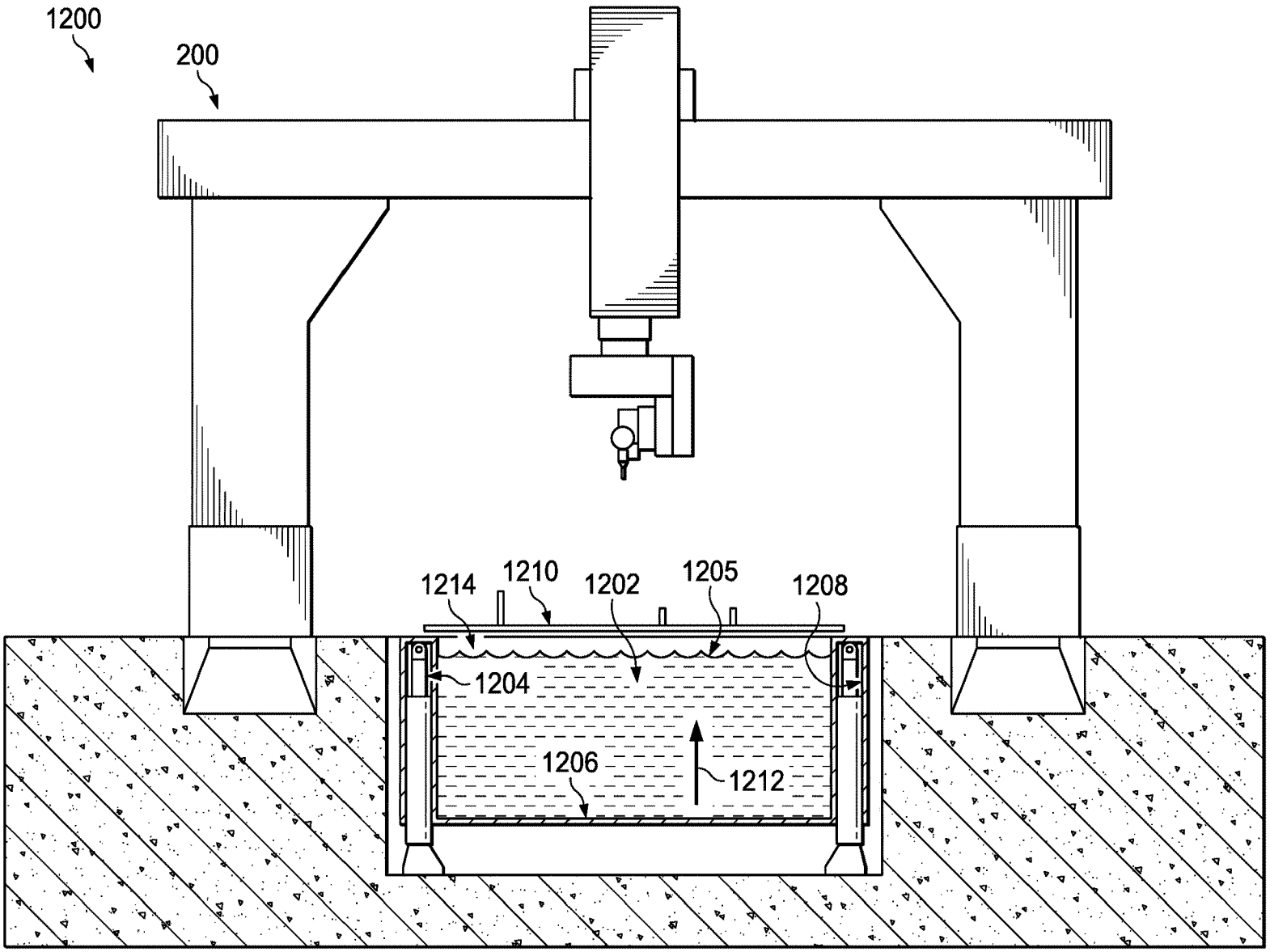
FIG. 12 is an illustration of a front cross-sectional view of a manufacturing environment with a lifting tank in accordance with an illustrative embodiment.

Turning now to FIG. 12, an illustration of a front cross-sectional view of a manufacturing environment with a lifting tank is depicted in accordance with an illustrative embodiment. View 1200 is a front cross-sectional view of manufacturing environment 200 prior to introducing index table 204 and workpiece 302 of FIG. 3. Tank 1202 and number of actuators 1204 are visible in view 1200. Tank 1202 may also be referred to as a lifting tank.

Tank 1202 is configured to hold fluid 1205. Tank 1202 has bottom 1206, number of walls 1208, and open top end 1210. Number of actuators 1204 is configured to move tank 1202 in direction 1212 perpendicular to bottom 1206 of tank 1202. Stable level 1214 of fluid 1205 is maintained within tank 1202.

In this illustrative example, rails 216 are below upper surface 218 of manufacturing floor 206. Having rails 216 below upper surface 218 will increase access to work envelope for all personnel. Manufacturing floor 206 including placement of rails 216 adds to overall ergonomics and safety of manufacturing environment 200.

In this illustrative example, tank 1202 is below ground. In other illustrative examples, configuration of tank 1202 is above ground. Tank 1202 being below ground may present advantageous ergonomic benefits for operators.

Figure 13:
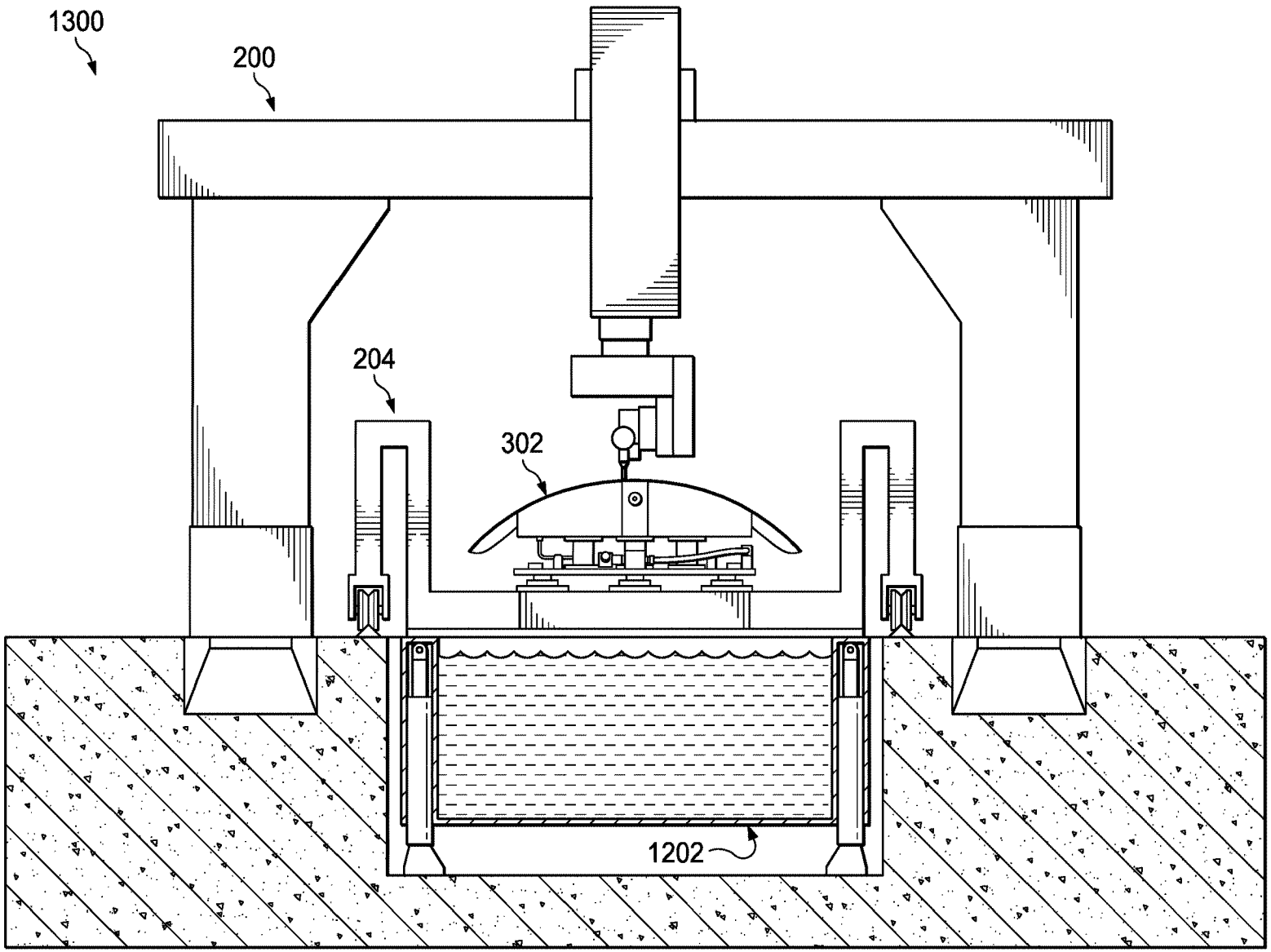
FIG. 13 is an illustration of a front cross-sectional view of a manufacturing environment with a lifting tank in a first position in accordance with an illustrative embodiment.

Turning now to FIG. 13, an illustration of a front cross-sectional view of a manufacturing environment with a lifting tank in a first position is depicted in accordance with an illustrative embodiment. View 1300 is a front cross-sectional view of manufacturing environment 200. As can be seen in view 1300, index table 204 and workpiece 302 are positioned over tank 1202.

Figure 14:
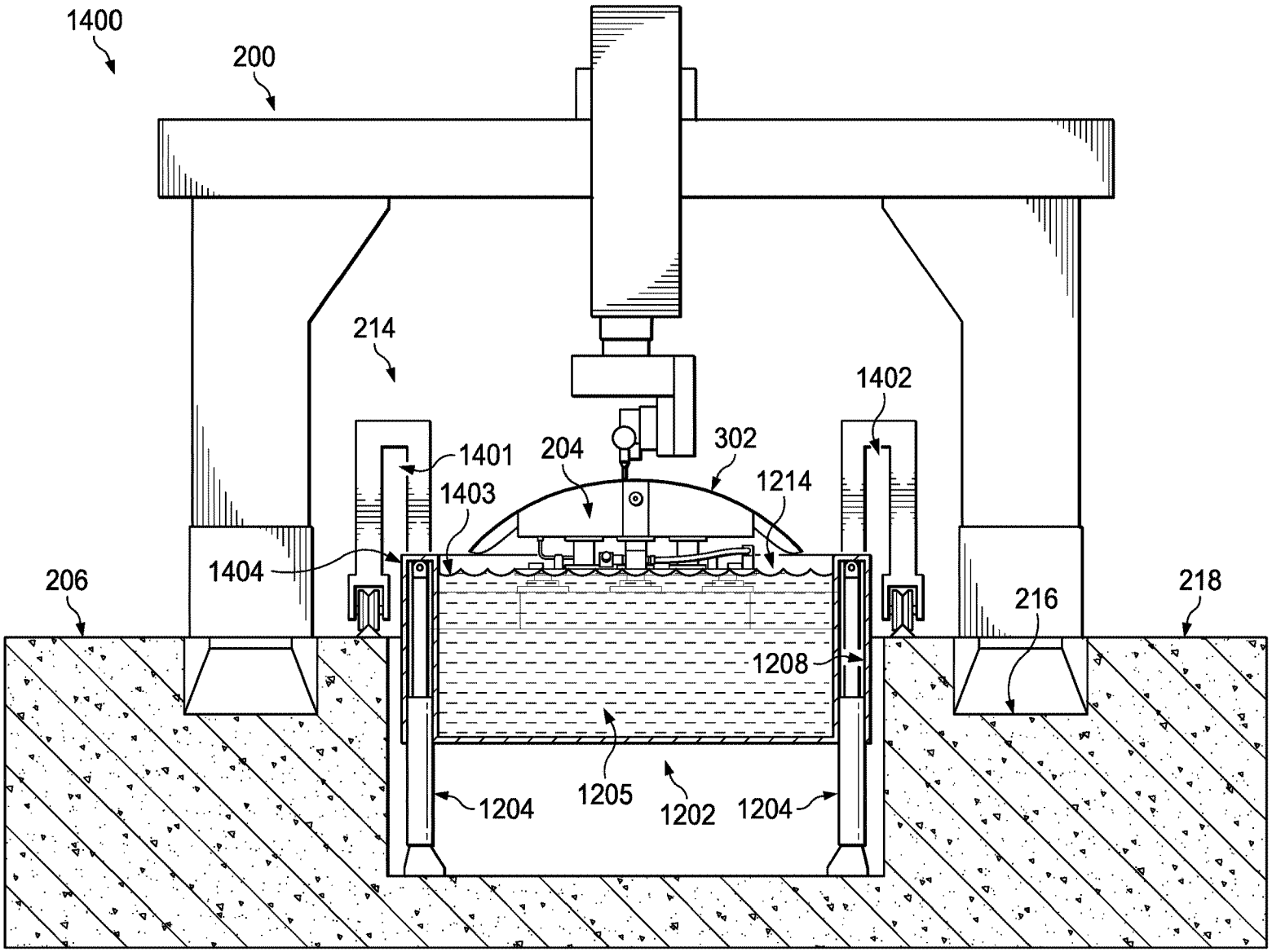
FIG. 14 is an illustration of a front cross-sectional view of a manufacturing environment with a lifting tank in a second position in accordance with an illustrative embodiment.

Turning now to FIG. 14, an illustration of a front cross-sectional view of a manufacturing environment with a lifting tank in a second position is depicted in accordance with an illustrative embodiment. In view 1400 of manufacturing environment 200, tank 1202 has been lifted using number of actuators 1204. As depicted in view 1400, when tank 1202 is lifted, number of walls 1208 move into channel 1401 and channel 1402 of index table 204. Further, as depicted in view 1400, stable level 1214 of fluid 1205 is maintained within tank 1202. When tank 1202 is lifted relative to index table 204, top surface 1403 of fluid 1205 within tank 1202 is lifted relative to index table 204 as well. In view 1400, tank 1202 is at position 1404.

Figure 15:
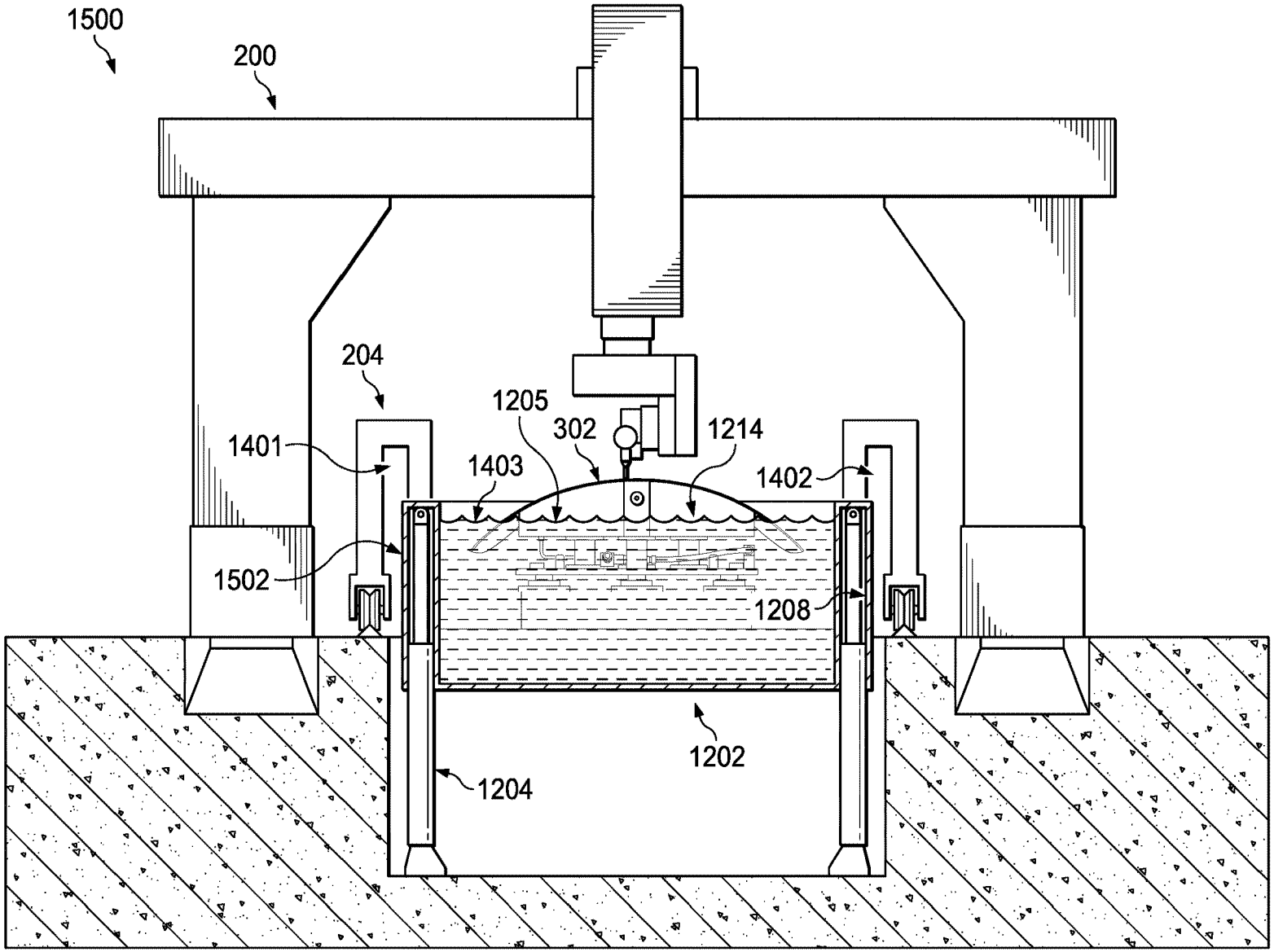
FIG. 15 is an illustration of a front cross-sectional view of a manufacturing environment with a lifting tank in a third position in accordance with an illustrative embodiment.

Turning now to FIG. 15, an illustration of a front cross-sectional view of a manufacturing environment with a lifting tank in a third position is depicted in accordance with an illustrative embodiment. In view 1500 of manufacturing environment 200, tank 1202 has been lifted using number of actuators 1204. As depicted in view 1500, when tank 1202 is lifted, number of walls 1208 move into channel 1401 and channel 1402 of index table 204. Further, as depicted in view 1500, stable level 1214 of fluid 1205 is maintained within tank 1202. When tank 1202 is lifted relative to index table 204, top surface 1403 of fluid 1205 within tank 1202 is lifted relative to index table 204 as well.

After raising tank 1202 relative to index table 204, tank 1202 contains a portion of index table 204. Top surface 1403 of fluid 1205 within tank 1202 is at a desirable height relative to workpiece 302. In view 1500, tank 1202 is at position 1502.

Figure 16:
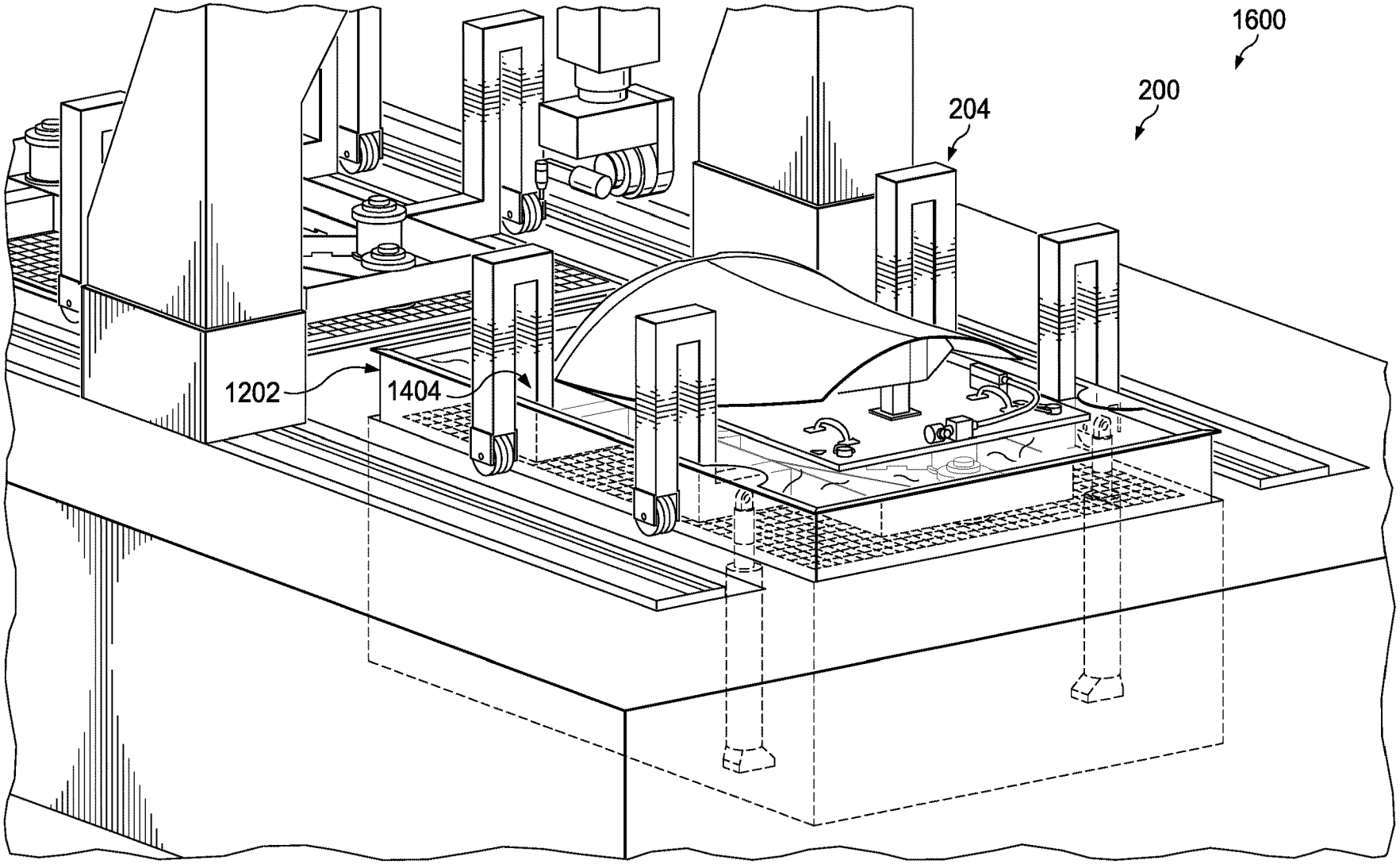
FIG. 16 is an illustration of an isometric view of a manufacturing environment with a lifting tank in a second position in accordance with an illustrative embodiment.

Turning now to FIG. 16, an illustration of an isometric view of a manufacturing environment with a lifting tank in a second position is depicted in accordance with an illustrative embodiment. View 1600 is an isometric view of manufacturing environment 200 with tank 1202 raised relative to index table 204. In view 1600, tank 1202 is at position 1404 of FIG. 14.

Figure 17:
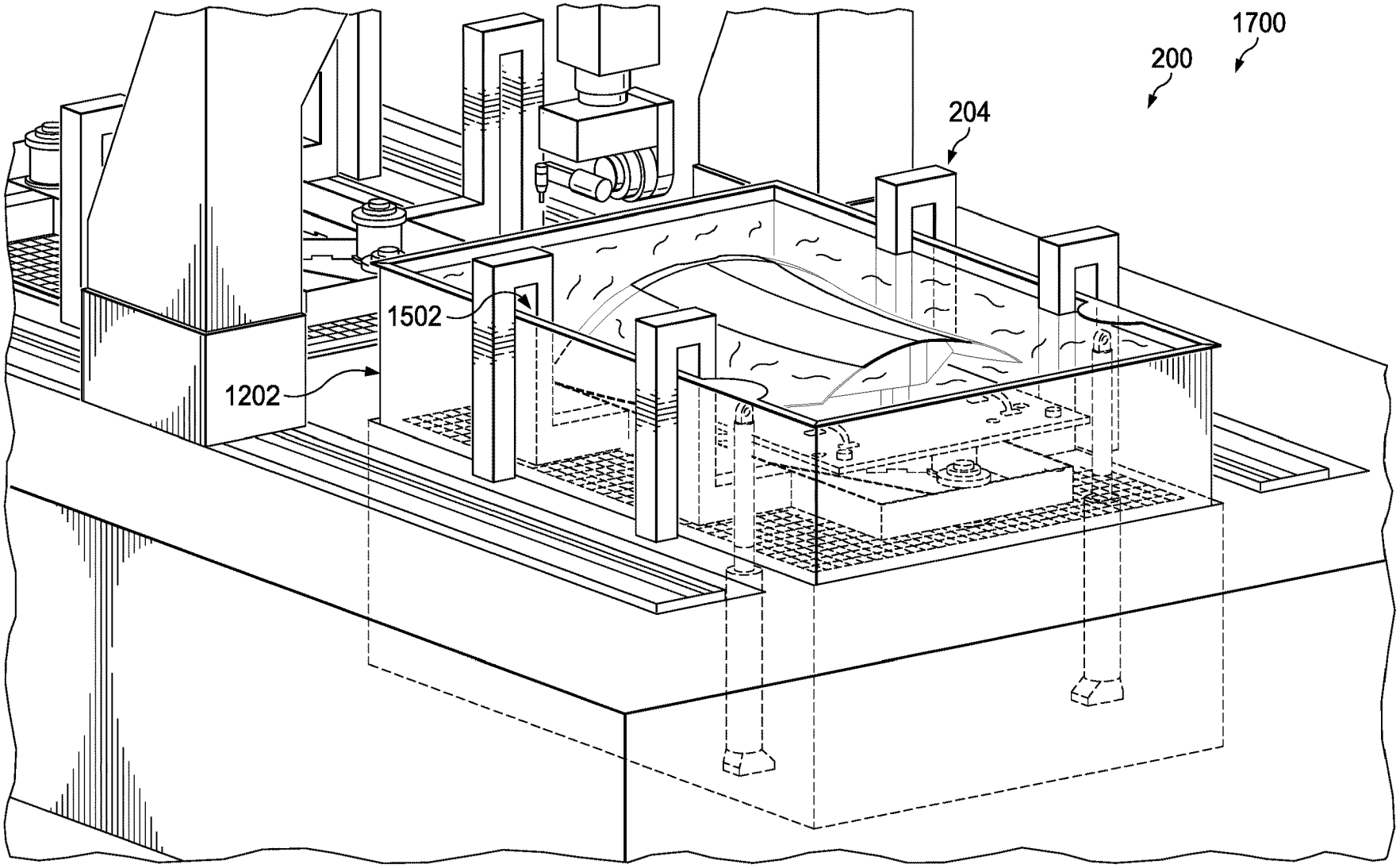
FIG. 17 is an illustration of an isometric view of a manufacturing environment with a lifting tank in a third position in accordance with an illustrative embodiment.

Turning now to FIG. 17, an illustration of an isometric view of a manufacturing environment with a lifting tank in a third position is depicted in accordance with an illustrative embodiment. View 1700 is an isometric view of manufacturing environment 200 with tank 1202 raised relative to index table 204. In view 1700, tank 1202 is at position 1502 of FIG. 15.

Figure 18:
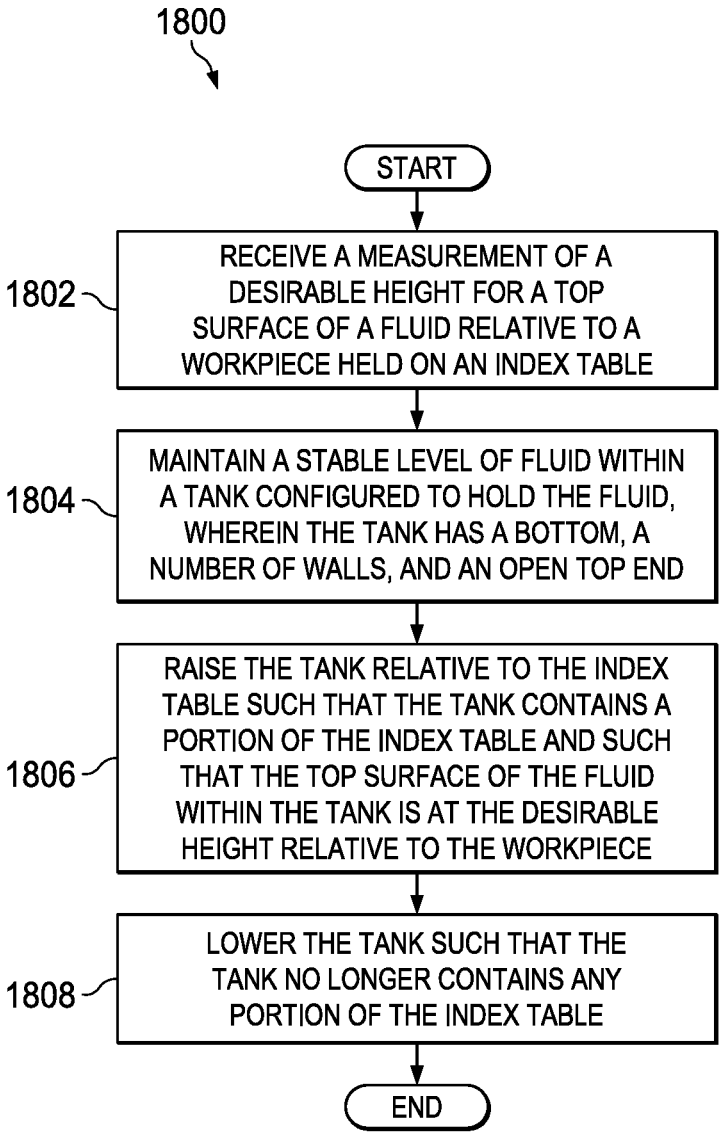
FIG. 18 is an illustration of a flowchart of a method for processing a workpiece in accordance with an illustrative embodiment.

Turning now to FIG. 18, an illustration of a flowchart of a method for processing a workpiece is depicted in accordance with an illustrative embodiment. Method 1800 may use tank 104 and index table 108 of FIG. 1. Method 1800 may be performed in manufacturing environment 200 of FIG. 2 using tank 1202 and index table 204 of FIG. 12.

Method 1800 receives a measurement of a desirable height for a top surface of a fluid relative to a workpiece held on an index table (operation 1802). The desirable height for the top surface of the fluid may be associated with a desired position of a tool performing a manufacturing process on the workpiece.

Method 1800 maintains a stable level of fluid within a tank configured to hold the fluid, wherein the tank has a bottom, a number of walls, and an open top end. Method 1800 raises the tank relative to the index table such that the tank contains a portion of the index table and such that the top surface of the fluid within the tank is at the desirable height relative to the workpiece (operation 1806). Method 1800 lowers the tank such that the tank no longer contains any portion of the index table (operation 1808). Afterwards, the process terminates.

The flowcharts and block diagrams in the different depicted illustrative embodiments illustrate the architecture, functionality, and operation of some possible implementations of apparatuses and methods in an illustrative embodiment. In this regard, each block in the flowcharts or block diagrams may represent a module, a segment, a function, and/or a portion of an operation or step.

In some alternative implementations of an illustrative embodiment, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

In some illustrative examples, method 1800 further comprises performing a manufacturing function on a location of the workpiece using a tool when the top surface of the fluid within the tank is at the desirable height. In these illustrative examples, the manufacturing function may be one of jet cutting or probing.

In some illustrative examples, method 1800 further comprises receiving a measurement of a second desirable height for the top surface of the fluid relative to the workpiece, moving the tank relative to the workpiece such that the top surface of the fluid within the tank is at the second desirable height, and performing a manufacturing function on a second location of the workpiece using a tool when the top surface of the fluid within the tank is at the second desirable height.

In other illustrative examples, method 1800 further comprises moving the workpiece away from the tank after lowering the tank such that the workpiece is no longer above the tank. In some examples, moving the workpiece away from the tank comprises moving the index table away from the tank using movement systems connected to the index table. In some examples, the movement systems are connected to legs of the index table.

Figure 19:
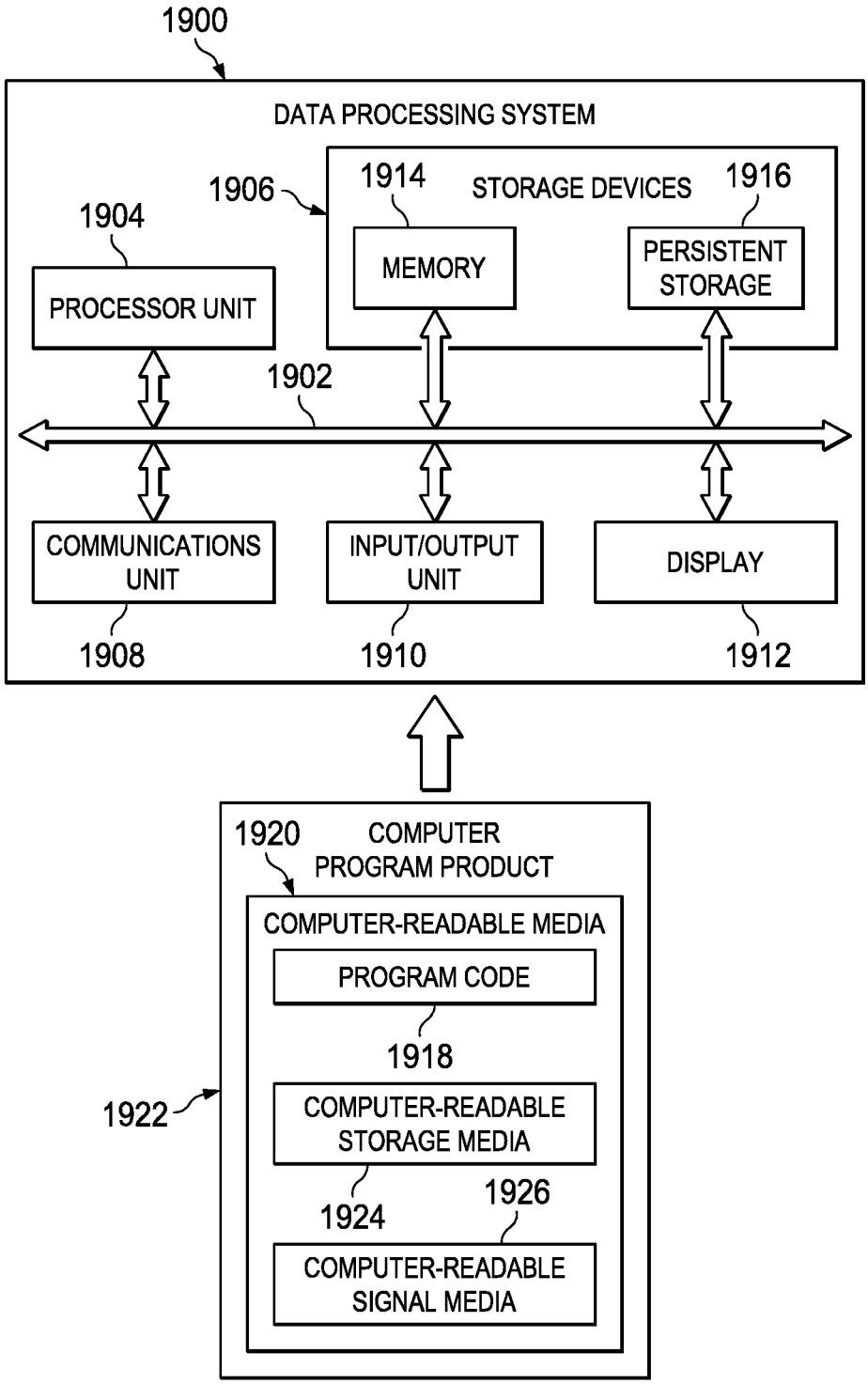
FIG. 19 is an illustration of a data processing system in the form of a block diagram in accordance with an illustrative embodiment.

Turning now to FIG. 19, an illustration of a data processing system in the form of a block diagram is depicted in accordance with an illustrative embodiment. Data processing system 1900 may be used to implement controller 150 of FIG. 1. Data processing system 1900 may be used to send commands to equipment, such as number of actuators 106, tool 118, or movement system 120 of FIG. 1. As depicted, data processing system 1900 includes communications framework 1902, which provides communications between processor unit 1904, storage devices 1906, communications unit 1908, input/output unit 1910, and display 1912. In some cases, communications framework 1902 may be implemented as a bus system.

Processor unit 1904 is configured to execute instructions for software to perform a number of operations. Processor unit 1904 may comprise a number of processors, a multiprocessor core, and/or some other type of processor, depending on the implementation. In some cases, processor unit 1904 may take the form of a hardware unit, such as a circuit system, an application specific integrated circuit (ASIC), a programmable logic device, or some other suitable type of hardware unit.

Instructions for the operating system, applications, and/or programs run by processor unit 1904 may be located in storage devices 1906. Storage devices 1906 may be in communication with processor unit 1904 through communications framework 1902. As used herein, a storage device, also referred to as a computer-readable storage device, is any piece of hardware capable of storing information on a temporary and/or permanent basis. This information may include, but is not limited to, data, program code, and/or other information.

Memory 1914 and persistent storage 1916 are examples of storage devices 1906. Memory 1914 may take the form of, for example, a random-access memory or some type of volatile or non-volatile storage device. Persistent storage 1916 may comprise any number of components or devices. For example, persistent storage 1916 may comprise a hard drive, a flash memory, a rewritable optical disk, a rewritable magnetic tape, or some combination of the above. The media used by persistent storage 1916 may or may not be removable.

Communications unit 1908 allows data processing system 1900 to communicate with other data processing systems and/or devices. Communications unit 1908 may provide communications using physical and/or wireless communications links.

Input/output unit 1910 allows input to be received from and output to be sent to other devices connected to data processing system 1900. For example, input/output unit 1910 may allow user input to be received through a keyboard, a mouse, and/or some other type of input device. As another example, input/output unit 1910 may allow output to be sent to a printer connected to data processing system 1900.

Display 1912 is configured to display information to a user. Display 1912 may comprise, for example, without limitation, a monitor, a touch screen, a laser display, a holographic display, a virtual display device, and/or some other type of display device.

In this illustrative example, the processes of the different illustrative embodiments may be performed by processor unit 1904 using computer-implemented instructions. These instructions may be referred to as program code, computer-usable program code, or computer-readable program code, and may be read and executed by one or more processors in processor unit 1904.

In these examples, program code 1918 is located in a functional form on computer-readable media 1920, which is selectively removable, and may be loaded onto or transferred to data processing system 1900 for execution by processor unit 1904. Program code 1918 and computer-readable media 1920 together form computer program product 1922. In this illustrative example, computer-readable media 1920 may be computer-readable storage media 1924 or computer-readable signal media 1926.

Computer-readable storage media 1924 is a physical or tangible storage device used to store program code 1918 rather than a medium that propagates or transmits program code 1918. Computer-readable storage media 1924 may be, for example, without limitation, an optical or magnetic disk or a persistent storage device that is connected to data processing system 1900.

Alternatively, program code 1918 may be transferred to data processing system 1900 using computer-readable signal media 1926. Computer-readable signal media 1926 may be, for example, a propagated data signal containing program code 1918. This data signal may be an electromagnetic signal, an optical signal, and/or some other type of signal that can be transmitted over physical and/or wireless communications links.

The illustration of data processing system 1900 in FIG. 19 is not meant to provide architectural limitations to the manner in which the illustrative embodiments may be implemented. The different illustrative embodiments may be implemented in a data processing system that includes components, in addition to or in place of those illustrated, for data processing system 1900. Further, components shown in FIG. 19 may be varied from the illustrative examples shown.

The illustrative embodiments provide an apparatus and method for a tank configured to be raised relative to a workpiece. By maintaining a stable level of a fluid within the tank, filling and draining equipment may be reduced or eliminated. Further, by maintaining the stable level of the fluid within the tank and raising or lowering the tank enables removal of a fixture loader, enables use of the illustrative examples of movement systems, and enables the illustrative examples of index tables.

When the workpiece is a formed blank, the illustrative examples reduce the time it takes for the process to produce one instance of the formed blank. The illustrative examples also improve ergonomic and safety operation.

The illustrative examples do not change how operators interact with the system. The illustrative examples may increase intuitiveness of the system.

The illustrative examples seek overall affordability by reducing or eliminating undesirable manufacturing downtime, reducing or eliminating equipment, and reducing or eliminating the footprint of the equipment.

In the illustrative examples, there is no filling and emptying of tank. In the illustrative examples, the non-productive time is the time it takes to raise and lower the tank. This time may be less than using a pump.

In the illustrative examples, there is possibly no reservoir tank. Eliminating the reservoir tank may make the overall foot print smaller. The water level may be set by NC program command to lift and lower the tank (this is "U" axis). Potential time savings by cutting time.

In the illustrative examples, there are no loading sensors in the tank. In the illustrative examples, the loading sensors may be on a loading table where they can be managed by an operator. Thus, any sensor errors during attachment of a vacuum system to the loading table may be attended to by the operator prior to lifting the tank.

In the illustrative examples, there is a potential of a reduced cost of acquisition. For example, the tank that can be raised may be smaller than conventional tanks. In conventional systems, the size of the tank was determined by the loader/lifting mechanism. By removing the loader, the illustrative examples may reduce calibration time of the equipment.

In the illustrative examples, the five-axis water jet consists of a lifting tank and a suspended table support structure. The tank design may include features on walls and a floor to reduce the amount of water required. The tank is always full of water and it is lifted and lowered vertically. The support structure is a two pin index and three pad support structure suspended on "legs" that are mounted to the floor. The support structure may also be referred to as an index table. These "legs" allow the tank to lift to fully submerge the fixture and workpiece assembly for cutting.

In the illustrative examples, hardware to fill and empty the tank may be eliminated. A static water tank with filling and draining water utilizes hardware which in turn causes non-value added time to the process.

The time it takes to lift and lower a full tank of water may be considerably less than filling it and emptying it. Furthermore, the reduced work space of the illustrative examples offers improves ergonomic and safety aspects of operation for all personnel.

These illustrative examples improve the conventional design of the five-axis water jet by removing the fixture loader which saves time and floor space and results on a potentially smaller tank. In the illustrative examples, ergonomics and safety are enhanced and time is saved. By removing the reservoir, pump and modifying the tank from fixed to a lifting tank, a reduction in process time is achieved.

The above modifications enhance the ergonomic and safety aspects of operation and access by all personnel, as well as increase capacity, saving floor space, maximize cutting envelope, and has the potential of lower cost of acquisition and operation.

In the illustrative examples, a lifting water jet tank is synchronized with a five-axis water jet cutter such that the water jet cutter position is communicated with a controller. The controller commands the necessary height of the water jet tank. (A lifting water jet tank integrated with a five-axis water jet cutter such that the water jet cutter position and the desired height of the water jet tank are communicated).

One illustrative workpiece is formed sheet metal. Formed sheet metal is used in various industries including the aerospace industry. The formed sheet does not typically have finished edges, and thus some form of cutting is used. Five-axis position water jet cutters are available and can be used to cut the edges. However, conventional water jet cutters may have undesirable effects such as noise and water spent unnecessarily due to splashing.

The illustrative examples move the tank to a relative position of the water jet cutter such that the water jet cutter nozzle is at a desired position relative to the water surface in the tank. Such position will ensure reasonable noise levels, tooling life, reduction in water waste, and faster manufacturing time due to less time wasted on positioning workpieces.

In some illustrative examples, a tank with angled walls may be used. In some illustrative examples, the tank is designed so that it holds a minimal amount of water. For example, rounded corners, gussets, or "bumps" may be present in the tank.

The illustrative examples provide a system for water jet cutting. The system may comprise an actuatable water tank and a loading table. The actuatable water tank is configured to hold a volume of water therein and has an open top end. The water tank further comprises side walls and a closed bottom end that define the volume. The loading table comprises a plurality of legs and a table. In some examples, the legs comprise a channel such that the tank side walls can slidably travel within the channel of the plurality of legs and the table sized such that it travels within the tank when the tank side walls are traveling within the channel.

The system with actuatable water tank further comprises a plurality of actuators configured to lower and raise the tank, the plurality of actuators in electronic communication with a controller. The controller is in communication with a computer and in electronic communication with the five-axis water jet cutter. The table further comprises a roller engageable on a rail.

In some illustrative examples, a method is presented. The 3-D coordinate position of the five-axis water jet cutting nozzle is determined. A desired distance between the five-axis water jet cutting nozzle with a water surface of the water tank is determined. The surface of the water is positioned in real time by raising or lowering the water tank, such that the position of the water tank moves relative to the five-axis water jet cutting nozzle such that the desired distance between the five-axis water jet cutting nozzle with the water surface of the water tank is always maintained.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A system comprising:

an index table configured to hold a workpiece;

a tank configured to hold a fluid, the tank having a bottom, a number of walls, and an open top end;

a number of actuators configured to lift the tank in a direction perpendicular to the bottom of the tank such that the tank contains a portion of the index table;

a tool connected to a gantry system, wherein the tool is configured to perform a number of manufacturing functions on the workpiece, wherein the tool is suspended above the tank; and a controller configured to send commands to the number of actuators to at least one of lift or lower the tank such that a desirable height of a top surface of a fluid in the tank relative to a top surface of the workpiece is maintained as the tool moves across the workpiece when a stable level of fluid is within the tank, wherein lifting the tank disposes a wall of the tank within a channel of the index table, and wherein the desirable height is associated with a position of the tool as it performs a manufacturing process on the workpiece such that the desirable height changes as the tool moves across the workpiece due to elevations of the workpiece.

2. The system of claim 1, wherein the index table has a number of indexing locations, the system further comprising:

a vacuum system having indexing locations to interface with the number of indexing locations of the index table and a second surface having a shape complementary to a first surface of the workpiece, wherein the vacuum system connects the workpiece to the index table.

3. The system of claim 1, wherein the gantry system is configured to move in a first direction relative to the tank, and wherein the tool is configured to move relative to the gantry system in a second direction perpendicular to the first direction.

4. The system of claim 1, wherein the index table is connected to a movement system, and the movement system is configured to move the index table and the workpiece away from the tank and the gantry system.

5. The system of claim 4, wherein the movement system comprises at least one wheel.

6. The system of claim 1, wherein the desirable height of the top surface of the fluid relative to the workpiece corresponds to a desired distance between the tool and a surface of the fluid.

7. The system of claim 1, wherein the channel is formed by a leg of the index table, wherein the leg is one of a plurality of legs, and wherein each leg of the plurality of legs is connected to a respective movement system.

8. A system comprising:

an index table configured to hold a workpiece;

a tank configured to hold a fluid, the tank having a bottom, a number of walls, and an open top end, wherein the tank is disposed within a hollow of a manufacturing floor;

a number of actuators configured to move the tank in a direction perpendicular to the bottom of the tank such that the tank contains a portion of the index table;

a tool connected to a gantry system, wherein the tool is configured to perform a number of manufacturing functions on the workpiece, wherein the tool is suspended above the tank; and a controller configured to send commands to the number of actuators to move the tank such that a desirable height of a top surface of a fluid in the tank relative to the workpiece is maintained as the tool moves across the workpiece when a stable level of fluid is within the tank, wherein the desirable height is associated with a position of the tool as it performs a manufacturing process on the workpiece such that the desirable height changes as the tool moves across the workpiece due to elevations of the workpiece;

and wherein:

the index table is held above the hollow of the manufacturing floor;

the desirable height of the top surface of the fluid relative to the workpiece corresponds to the fluid covering the tool;

the index table has a number of indexing locations, and comprising a vacuum system having indexing locations to interface with the number of indexing locations of the index table and a second surface having a shape complementary to a first surface of the workpiece, wherein the vacuum system connects the workpiece to the index table;

the gantry system is configured to move in a first direction relative to the tank; and the tool is configured to move relative to the gantry system in a second direction perpendicular to the first direction.

9. A system comprising:

an index table configured to hold a workpiece;

a tank configured to hold a fluid, the tank having a bottom, a number of walls, and an open top end, wherein the tank is disposed within a hollow of a manufacturing floor;

a number of actuators configured to move the tank in a direction perpendicular to the bottom of the tank;

a tool connected to a gantry system, wherein the tool is configured to perform a number of manufacturing functions on the workpiece, and the tool is suspended above the tank; and a controller configured to send commands to the number of actuators to lift the tank prior to performance of a manufacturing function, to move the tank during performance of the manufacturing function on the workpiece by the tool such that a desirable height of a top surface of a fluid in the tank relative to the workpiece is maintained, and lower the tank following performance of the manufacturing function, wherein:

before lifting the tank with the number of actuators, a top surface of the fluid is disposed lower than an uppermost surface of the manufacturing floor;

the desirable height is associated with a position of the tool as it performs the manufacturing function on the workpiece such that the desirable height changes as the tool moves across the workpiece due to elevations of the workpiece, and while moving the tank with the number of actuators during performance of the manufacturing function, the top surface of the fluid is disposed higher than the uppermost surface of the manufacturing floor.

10. The system of claim 9, wherein the tank contains a portion of the index table.

11. The system of claim 9, wherein the controller is further configured to maintain a desired height of a top surface of a fluid in the tank relative to the workpiece as the tool moves across the workpiece.

12. The system of claim 9, wherein the index table has a number of indexing locations, and comprising a vacuum system having indexing locations to interface with the number of indexing locations of the index table and a second surface having a shape complementary to a first surface of the workpiece, wherein the vacuum system connects the workpiece to the index table.

13. The system of claim 9, wherein the gantry system is configured to move in a first direction relative to the tank.

14. The system of claim 9, wherein the tool is configured to move relative to the gantry system in a second direction perpendicular to a first direction.

15. The system of claim 9, wherein the index table is connected to a movement system.

16. The system of claim 15, wherein the movement system is configured to move the index table and the workpiece away from the tank and the gantry system.

17. The system of claim 16, wherein the tank contains a portion of the index table.

18. The system of claim 17, wherein the controller is further configured to maintain a desired height of a top surface of a fluid in the tank relative to the workpiece as the tool moves across the workpiece.

19. The system of claim 18, wherein the index table has a number of indexing locations, and comprising a vacuum system having indexing locations to interface with the number of indexing locations of the index table and a second surface having a shape complementary to a first surface of the workpiece, wherein the vacuum system connects the workpiece to the index table.

20. The system of claim 19, wherein:

the gantry system is configured to move in a first direction relative to the tank; and the tool is configured to move relative to the gantry system in a second direction perpendicular to the first direction.

* * * * *